US010562064B2

(12) United States Patent
Lavelanet et al.

(10) Patent No.: US 10,562,064 B2
(45) Date of Patent: Feb. 18, 2020

(54) HEAD PLATE DEVICE, STORAGE CONTAINER DEVICE, CARTRIDGE ARRANGEMENT, DISPENSING APPARATUS, AND THEIR USAGE

(71) Applicant: SIKA TECHNOLOGY AG, Baar (CH)

(72) Inventors: Richard Lavelanet, Balgach (CH); Andreas Hiemer, Schübelbach (CH)

(73) Assignee: SIKA TECHNOLOGY AG, Baar (CH)

( * ) Notice: Subject to any disclaimer, the term of this patent is extended or adjusted under 35 U.S.C. 154(b) by 207 days.

(21) Appl. No.: 15/513,807

(22) PCT Filed: Sep. 18, 2015

(86) PCT No.: PCT/EP2015/071511
§ 371 (c)(1),
(2) Date: Mar. 23, 2017

(87) PCT Pub. No.: WO2016/046098
PCT Pub. Date: Mar. 31, 2016

(65) Prior Publication Data

US 2018/0229260 A1 Aug. 16, 2018

(30) Foreign Application Priority Data

Sep. 23, 2014 (EP) ..... 14185972

(51) Int. Cl.
*B05C 17/005* (2006.01)

(52) U.S. Cl.
CPC .. *B05C 17/00506* (2013.01); *B05C 17/00553* (2013.01)

(58) Field of Classification Search
CPC ..... B05C 17/00506; B05C 17/00553
(Continued)

(56) References Cited

U.S. PATENT DOCUMENTS 3,323,682 A * 6/1967 Creighton, Jr. ... B05C 17/00513 222/105
3,390,814 A * 7/1968 Creighton, Jr. ..... B01F 11/0082 222/137

(Continued)

FOREIGN PATENT DOCUMENTS

CN 1659084 A 8/2005
CN 101023905 A 8/2007

(Continued)

OTHER PUBLICATIONS

International Search Report (PCT/ISA/210) dated Feb. 12, 2016, by the European Patent Office as the International Searching Authority for International Application No. PCT/EP2015/071511.

(Continued)

*Primary Examiner* — Patrick M. Buechner
*Assistant Examiner* — Michael J. Melaragno
(74) *Attorney, Agent, or Firm* — Oliff PLC

(57) ABSTRACT

A head plate device is disclosed for a cartridge arrangement for a dispensing apparatus for dispensing at least two flowable components. The head plate device includes at least two separate outlet openings for respectively dispensing the at least two flowable components, and at least two separate inlet passages of the head plate device through which the at least two flowable components can be introduced and flowed through separately from one another. A corresponding storage container device, a cartridge arrangement, and a dispensing apparatus combining a head plate device and a storage container device with a mixer device are disclosed.

19 Claims, 21 Drawing Sheets

(58) Field of Classification Search
USPC ..... 222/145.6, 326
See application file for complete search history.

(56) References Cited

U.S. PATENT DOCUMENTS 4,854,482 A * 8/1989 Bergner ..... B05C 17/005 222/94
4,981,241 A * 1/1991 Keller ..... A61M 5/19 222/137
5,161,715 A 11/1992 Giannuzzi
5,184,757 A * 2/1993 Giannuzzi ..... B05C 17/00506 141/334
5,242,082 A 9/1993 Giannuzzi
5,293,913 A * 3/1994 Preszler ..... B41J 2/17523 141/100
5,314,412 A * 5/1994 Rex ..... A61M 5/19 222/137
5,458,262 A * 10/1995 Keller ..... B05C 17/00509 222/135
5,530,531 A * 6/1996 Girard ..... B41J 2/1755 222/DIG. 1
5,535,924 A * 7/1996 Nilsson ..... B65D 83/0005 215/256
5,697,524 A * 12/1997 Sedlmeier ..... B01F 13/002 222/105
5,819,988 A * 10/1998 Sawhney ..... B05C 17/00506 222/137
5,875,928 A * 3/1999 Muller ..... B05C 17/00553 222/137
5,897,028 A 4/1999 Sauer
5,918,772 A * 7/1999 Keller ..... B05C 17/00506 222/145.5
6,065,645 A * 5/2000 Sawhney ..... B01F 5/0615 222/137
6,186,363 B1 * 2/2001 Keller ..... B05C 17/00506 222/137
6,244,740 B1 * 6/2001 Wagner ..... B01F 7/0075 222/145.6
6,299,022 B1 * 10/2001 Bublewitz ..... B05C 17/00506 222/105
6,311,871 B1 * 11/2001 Binder ..... B05C 17/00516 222/145.6
6,443,612 B1 * 9/2002 Keller ..... B01F 7/00141 222/145.6
6,575,340 B2 * 6/2003 Steinel ..... B05C 17/00516 222/146.2
6,629,774 B1 * 10/2003 Gruendeman ..... B05C 17/002 222/145.6
6,644,509 B1 * 11/2003 Bublewitz ..... B05C 17/00506 222/105
6,932,243 B2 * 8/2005 Keller ..... B01F 7/00141 222/145.6
7,370,777 B2 * 5/2008 Hefele ..... F16L 15/001 222/520
7,506,783 B2 * 3/2009 Brennan ..... B05C 17/00553 222/137
8,028,859 B2 * 10/2011 Paetow ..... B65D 81/3244 222/107
8,033,429 B2 * 10/2011 Keller ..... B05C 17/00506 222/137
8,147,122 B2 * 4/2012 Pieroni ..... B01F 7/008 222/145.6
8,162,179 B2 * 4/2012 Willner ..... B05C 17/00553 222/105
9,149,775 B2 * 10/2015 Hiemer ..... A61C 9/0026
9,205,970 B2 * 12/2015 Rahm ..... B05C 17/00503
9,289,797 B2 * 3/2016 Pappalardo ..... B05C 17/00506
D757,509 S * 5/2016 Rahm ..... D8/14.1
9,878,335 B2 * 1/2018 Muller ..... B01F 5/0609
2003/0137898 A1 * 7/2003 Wagner ..... B01F 7/00125 366/172.1
2008/0314929 A1 * 12/2008 Keller ..... B05C 17/00506 222/145.6
2009/0134186 A1 * 5/2009 Keller ..... B05C 17/00506 222/137
2009/0230344 A1 * 9/2009 Bodet ..... B65D 83/682 251/367
2009/0277926 A1 * 11/2009 Schell ..... B65D 81/3244 222/94
2010/0027918 A1 * 2/2010 Willner ..... B05C 17/00553 383/37
2011/0121035 A1 * 5/2011 Greter ..... A61C 9/0026 222/145.1
2011/0139821 A1 * 6/2011 Greter ..... A61B 17/00491 222/145.5
2012/0175384 A1 * 7/2012 Greter ..... A61M 5/19 222/137
2012/0279988 A1 * 11/2012 Hiemer ..... A61C 9/0026 222/82
2013/0048670 A1 * 2/2013 Greter ..... B05C 17/00586 222/82
2013/0087578 A1 * 4/2013 Brem ..... B05C 17/00509 222/82
2013/0277393 A1 * 10/2013 Rahm ..... B05C 17/00503 222/137
2014/0246454 A1 * 9/2014 Schulz ..... B65D 81/325 222/82
2016/0288158 A1 * 10/2016 Hiemer ..... B05C 11/1028
2017/0120206 A1 * 5/2017 Hiemer ..... B01F 5/061
2017/0156820 A1 * 6/2017 Hiemer ..... B05C 17/00593
2017/0239683 A1 * 8/2017 Schultheiss ..... B05C 17/00566
2017/0274414 A1 * 9/2017 Ruhstaller ..... B05C 17/00513
2017/0297049 A1 * 10/2017 Buck ..... B05C 17/00586

FOREIGN PATENT DOCUMENTS

CN 101595035 A 12/2009
CN 201506523 U 6/2010
CN 102069945 A 5/2011
DE 296 03 416 U1 4/1996
EP 2 520 360 A1 11/2012

OTHER PUBLICATIONS

Written Opinion (PCT/ISA/237) dated Feb. 12, 2016, by the European Patent Office as the International Searching Authority for International Application No. PCT/EP2015/071511.
Dec. 11, 2018 Office Action issued in Chinese Patent Application No. 201580051260.4.
Jul. 31, 2019 Office Action issued in Chinese Patent Application No. 201580051260.4.

* cited by examiner

HEAD PLATE DEVICE, STORAGE CONTAINER DEVICE, CARTRIDGE ARRANGEMENT, DISPENSING APPARATUS, AND THEIR USAGE

The present invention relates to a head plate device, to a storage container device, to a cartridge arrangement, to a dispensing apparatus comprising the cartridge arrangement and a mixer device, and the usage of the head plate, the storage container device, the cartridge arrangement, and the dispensing apparatus.

More specifically, the present invention relates to a head plate device for a cartridge arrangement for a dispensing apparatus for dispensing at least two flowable components, to a storage container device for a cartridge arrangement and configured for storing a flowable component, to a cartridge arrangement for a dispensing apparatus for dispensing at least two flowable components, to a dispensing apparatus comprising for dispensing at least two flowable components using the cartridge arrangement, and their usage.

For the purpose of mixing and dispensing at least two flowable components or media dispensing apparatuses—together with head plates having attached thereto a static or dynamic mixer on the one hand and plural storage containers on the other hand—are used in a variety of technical fields. This e.g. applies to the field of mixing and dispensing of two-component systems such as sealing compounds, two-component foams, two-component adhesives, and two-component filling media, e.g. in the dental medical field, for example for mixing and dispensing impression materials or the like. In addition, the field of storing, mixing, and/or dispensing at least two flowable components, in particular at least one of a sealant and an adhesive and/or for at least one of installing, fixing, gluing, sealing, and repairing a window, in particular a wind shield or wind screen of a vehicle, in particular in a car, is of high interest, too. The individual components usually have to remain separated from each other until the intended usage is begun. Upon use, the components are mixed and dispensed so that e.g. hardening can subsequently take place by a chemical reaction.

Such mixers are often designed for single use because in general cleaning is difficult after hardening or after any other chemical reaction of the components involved.

Storage container devices for storing and supplying the flowable components on the one hand and the mixer device on the other hand therefore often attached to a mediating means such as a head plate for which the present invention provides improvements.

Further, such head plates are—besides the mixers—are often part of a dispensing apparatus which further includes cartridges or other storage chambers for storing and supplying the respective components. In use, the individual components are dispensed from the chambers by means of a plunger or by means of a drivable piston, in order to move the components into the mixer.

Based on the head plate's and the mixer's operation, the components are intimately mixed and exit the mixer through an outlet opening thereof as a homogeneous mixture of the involved components.

There are many different designs with respect to the chambers for storing and supplying the components. The chambers can be designed, for example, as rigid cartridges which are inserted directly into the dispensing apparatus. In this respect, the cartridges can, for example, each have a piston as a base which is moved in the cartridge by exerting pressure to dispense the respective component.

According to other designs in which the cartridges have very thin walls, the cartridges are inserted into a support cartridge of the dispensing apparatus. Pressure is exerted on them by a plunger or by a piston. Provision can be made in this respect that the thin-walled cartridge collapses on dispensing within the support cartridge.

U.S. Pat. No. 4,981,241 relates to a dual dispenser cartridge, having two interlocked storages cylinders, separated by double walls, arranged axially parallel side-by-side, and each comprising one front end discharging opening, wherein both discharging openings are located next to each other on the common center line of both storage cylinders. The dual dispenser cartridge comprises a transition member, positioned ahead of the two storage cylinders. A permanent, axial push-fit connection between the transition member and the two storage cylinders is accomplished by means of a snap lock. This push-fit connection, however, does not provide a secure engagement against rotation but merely an axially snap-in connection.

Document DE 296 03 416 U1 relates to a cartridge for two-component materials. If a handle is actuated, foil bags are opened via cutting elements so that the material is introduced in a mixer. These cutting elements cannot establish a secure engagement with the flexible foil bag so that, again, a rotation is not securely blocked.

Document EP 2 520 360 A1 discloses a mixer for mixing at least two flowable components and a dispensing apparatus, wherein first and second containers for storing and supplying first and second flowable components are connected with their outlet passages to cooperating inlet passages of the mixer.

The coupling elements between the cartridges or storage containers on the one hand and those of the head plate on the other hand often have a circular geometry. Therefore, it may be possible that even after having coupled a cartridge or a storage container with its opening region—in particular an outlet—to the opening region of the mixer—in particular to an inlet—there remains a risk in the already coupled state of an inadvertent relative rotational motion between the storage container or the cartridge during operation. This is in particular a risk in case that a piston with a self-cutting thread is used for driving the supply process for one or plural of the flowable components.

Indeed, such a situation increases the risk of slippage and of loosening of the portions to be connected and thereby of unintended releasing of the cartridge or the storage container from the mixer or the intermediate portion between the mixer and the cartridge or storage container within the dispensing apparatus.

As a consequence, the reliability of the head plate, of the mixer device, of the storage container device, of the cartridge arrangement, and of and the dispensing apparatus and of their operation in a process of dispensing flowable media is reduced.

It is an object of the invention to provide a head plate device for a cartridge arrangement for a dispensing apparatus for dispensing at least two flowable components, a storage container device for a cartridge arrangement and configured for storing a flowable component, a cartridge arrangement for a dispensing apparatus for dispensing at least two flowable components, and a dispensing apparatus which are particular reliable in their usage and within dispensing processes and which have in particular a reduced risk of unintendedly releasing of coupled cartridges or storage containers from the site of the mixer or of the head plate device as an intermediate portion within an dispensing apparatus.

The object underlying the present invention is solved by a head plate device, by a storage container device, by a cartridge arrangement, by a dispensing apparatus, and their usage.

According to one aspect of the present invention a head plate device for a cartridge arrangement for a dispensing apparatus for dispensing at least two flowable components is provided.

The head plate device comprises at least two separate outlet openings for respectively dispensing the at least two flowable components and at least two separate inlet passages through which the at least two flowable components can be introduced and flowed through separately from one another to a respective one of the outlet openings.

Each of said inlet passages of the head plate device is designed for—preferably sealing—cooperation with one respective outlet passage of storage container device. At least one of the inlet passages of the head plate device comprises an inlet opening region of essentially circularly shaped cross-section with at least one of an inner periphery and an outer periphery. At least one of the inner periphery and the outer periphery comprises at least one engaging element. The at least one engaging element extends radially from the respective inner or outer periphery.

With these measures and in particular by having provided an engaging element on a periphery which extends radially from the periphery, a rotational motion of a coupled cartridge, storage container, storage container device or chamber for providing a flowable component is avoided when the cartridge, the storage container, the storage container device or the chamber has already reached its coupling position or has already occupied its coupling state by cooperation of the inlet passage of the mixer device or an intermediate portion thereof with the outlet passage of the cartridge, the storage container, the storage container device or the chamber. Thus a particular risk—in case that a piston with a self-cutting thread is used for driving the supply process for one or plural of the flowable components—can be reduced or even avoided.

In addition, the provided engaging elements may additionally or alternatively help an easy and reliable attachment of a storage container device on the head plate, e.g. by means of a snap, lock, latch, or click into place action. Thereby, an axial motion between attached storage container devices and the head plate and thus an unintended separation can be suppressed. In an alternative embodiment, the engaging element (engaging elements) is (are) configured to allow (at least to a certain extent) axial movement between the storage container device and the head plate (in a coupled state). In particular, the engaging element (engaging elements) is (are) configured to allow separation of the storage container device and the head plate (only) by an axial movement. In particular, the engaging element (engaging elements) is (are) adapted to hinder rotational movement (block rotational movement) between the storage container device and head plate and allow an axial movement between these parts (optionally until complete separation), in their coupled state. In their coupled state, storage container device and head plate may be connected by a press-fit. In general, in their coupled state, there may be no form-fit between storage container device and head plate hindering an axial movement between these parts. In any event, connection and separation of storage container device and head plate may be very simple and reliable. In particular, if the engaging element (the engaging elements) hinders (hinder) a rotational movement, which can be sufficient to avoid a decoupling of storage container device and head plate.

A head plate or head plate device in the sense of the present invention is an element and in particular a plate to which storage containers for storing and supplying a component can be or are attached. In practice, the storage containers are attached and fixed to the head plate and the arrangement formed by the head plate and the storage containers attached and fixed thereto is offered and e.g. sold to an end consumer. Such an arrangement is called a cartridge arrangement.

The head plate may also be referred to as an intermediate part or portion as in practice it is located between the attached storage containers and a mixer to which the components are fed for mixing.

In addition, the terms cartridge, storage container, storage container device and chamber are used as synonyms. The term storage container device is, however, used as a generic term. A storage container device may form a storage chamber by offering a space for directly receiving and storing a flowable component, thereby operating e.g. as self-supporting cartridge. Alternatively, a storage container device may form a storage chamber by offering a space for receiving a bellows type container, a foil type container, a collapsible cartridge or any other container, thereby operating as a supporting cartridge which only indirectly stores a flowable component.

The storage container device, in particular a cartridge may have rigid walls, in particular self-supporting walls.

In each case, a plunger, a piston, in particular comprising a self-cutting thread, or any other suitable means for initiating the components' flow may be provided, even when they are not explicitly shown in the figures.

Because of the underlying principle of sealing cooperation of the inlet passages of the mixer device with respect to outlet passages of the storage container device, this requires an engagement of the outlet passage of the storage container device with the engaging element located at or on the periphery of the inlet passage in question.

By means of such an engagement an axial movement and/or a rotational motion of the coupled storage container device about a common axis of symmetry of the coupled inlet and outlet passages is avoided, thereby producing a tighter fit of the coupled storage container device.

According to an additional or alternative measure of the present invention, the at least one engaging element is configured to engage with a cooperating and essentially complimentary engaging element of a corresponding outlet passage of a storage container device in a state where the inlet passage of the head plate device sealingly cooperates with the respective outlet passage of the storage container device.

Thereby a torque proof cooperation between the inlet passage of the head plate device and the respective outlet passage of the storage container device can be achieved by preventing a rotational movement about a respective symmetry axis underlying the essentially circularly shaped cross-section of the inner periphery and the outer periphery of the inlet passage of the head plate device.

Alternatively or additionally, a snap, lock, latch, or click into place action and/or a form fit, a press fit, and/or a force fit thereof can be achieved.

According to a preferred embodiment, the head plate device has opposed first and second sides, wherein the at least two separate inlet passages are formed on one of the first and second sides, wherein the at least the at least two separate outlet openings are formed on the other one of the first and second sides, and wherein in particular the number of inlet passages is identical to the number of outlet openings.

It is another aspect of the present invention to provide a storage container device for a cartridge arrangement for a dispensing apparatus which is configured for storing a flowable component. The storage container device provides or comprises a storage chamber for storing a flowable component and an outlet passage through which the flowable component can be discharged. The outlet passage of the storage container device is designed for—preferably sealing—cooperation with a respective inlet passage of a head plate device. The outlet passage of the storage container device comprises an outlet opening region of essentially circularly shaped cross-section with at least one of an inner periphery and an outer periphery. At least one of the inner periphery and the outer periphery comprises at least one engaging element. The at least one engaging element extends radially from respective inner periphery or outer periphery.

The at least one engaging element of the outlet passage of the storage container device is configured to engage with a cooperating and essentially complimentary engaging element of a corresponding inlet passage of a head plate device in a state where the outlet passage of the storage container device—preferably sealingly—cooperates with the respective inlet passage of the head plate device.

Thereby a torque proof cooperation between the outlet passage of the storage container device and the respective inlet passage of the head plate device is ensured by preventing a rotational movement about a respective symmetry axis underlying the essentially circularly shaped cross-sections of the inner and outer peripheries of the inlet and outlet passages.

Again, by means of such an engagement an axial movement and/or a rotational motion of the coupled storage container device about a common axis of symmetry of the coupled inlet and outlet passages is avoided, thereby producing a tighter fit of the coupled storage container device.

Also again, additionally or alternatively at least one of a snap, lock, latch, or click into place action and/or a form fit, a press fit, and a force fit may be achieved.

Preferably, a plurality of engaging elements—i.e. at least two—may be provided, wherein a first fraction—i.e. least one—of the plurality engaging elements is configured for achieving said torque proof cooperation be-tween the inlet passage of the head plate device and the respective outlet passage of the storage container device, and wherein a second fraction—i.e. also at least one—of the plurality of engaging elements is configured for achieving an engagement between the inlet passage of the head plate device and the respective out-let passage of the storage container device thereby avoiding an axial movement and an inadvertent spatial separation thereof. Therefore, an advantageous combination of avoiding axial on rotational movement can be achieved.

The general aspects of the head plate device and of the storage container device in view of the concepts (A) of involving a rotation prohibiting engaging element and (B) of providing an axial movement prohibiting engaging element have been presented so far. In general, a central idea of the present invention is a configuration of the outlet passage of the storage container device and inlet passage of the head plate device so that a rotation, in their coupled state is avoided. At the same time, an axial movement, in their coupled state, may be possible. In essence, the corresponding engaging elements are configured so that a rotation is blocked, whereas an axial movement may be allowed. In an alternative embodiment, such an axial movement may be also blocked. If an axial movement is—in principle—possible, it may be restricted by certain press-fit (without, in particular, an additional form-fit).

The following aspects define particularities of the respective engaging elements and in general apply to both the engaging elements of the head plate device and of storage chamber device.

An engaging element may be formed as a male member protruding either from the inner periphery of the respective inlet or outlet opening region of the respective inlet or outlet passage and radially inwardly or from the outer periphery of the respective inlet or outlet opening region of the respective inlet or outlet passage and radially outwardly.

On the other hand, an engaging element may be formed as a female member recessing either from the inner periphery of the respective inlet or outlet opening region of the respective inlet or outlet passage and radially outwardly or from the outer periphery of the respective inlet or outlet opening region of the respective inlet or outlet passage and radially inwardly.

The above given circumstances show that in each case the provided engaging element may be formed as a male protrusion or as a female recess on the respective periphery of an inlet opening region of the inlet passages of a head plate device or of an outlet opening region of an outlet passage of a storage container device.

That means that a male member as a protrusion in each case protrudes from the periphery at which the protrusion is located: From an outer periphery the protrusion protrudes outwardly in a radial direction and from an inner periphery the protrusion protrudes inwardly in the radial direction.

A male member may have a rectangular shape and be, preferably, arranged so that two sides of the rectangular shape are in contact with surrounding parts of the head plate device or storage container device, respectively. Similarly, as an alternative or in addition, the female member may have a rectangular cross-section, wherein, preferably, two sides of the rectangular cross-section are open.

In general, a male member, if located at the head plate device, may have a first end, facing in the direction of the head plate device and a second end facing in the direction of the storage container device, wherein the first end is in contact with the head plate device and the second end can be inserted into a corresponding female member of the storage container device. Similarly, alternatively or in addition, if the engaging element is provided at the storage container device, it is preferred that the first end is free and the second end is in contact with the storage container device. Thereby, a simple and reliable blocking of rotation can be achieved.

Similarly, alternatively or in addition, if a female member is located at the head plate device, a first end of the female member (facing in the direction of the head plate device) may have a bottom, whereas a second end of the female member (facing in the direction of the storage container device) is free so that a corresponding male member may be inserted. If the female member is provided at the storage container device, the first end may be open and the second end may be closed by a bottom surface. Thereby, a simple and reliable blocking of rotation can be achieved.

On the other hand, a female member as a recess located on a respective periphery of an inlet opening region of an inlet passage of a head plate device or of an outlet opening region of an outlet passage of a storage container device recesses on an outer periphery inwardly in radial direction, whereas a recess on an inner periphery recesses outwardly in the radial direction.

All the provisions taken ensure an engaging interaction between the corresponding and coupled inlet and outlet passages where for a given engaging element situated at or on a periphery of an inlet opening region of an inlet passage of a head plate device corresponds to a provided and essentially complementary engaging element of the corresponding outlet opening region of the outlet passage of a storage container device.

If these outlet opening regions are coupled in a prescribed sense, the engaging elements—which correspond to each other—engage and thereby enhance tightness of the connection, avoid a slippage and reduce the risk of getting lost of the coupling by prohibiting a rotational motion of the coupled components about a common symmetry axis.

It is therefore an essential effect that by the provision of engaging elements a torque proof cooperation between an inlet passage and the corresponding and coupled outlet passage can be achieved.

Any geometry for the engaging element formed at or on the periphery of the inlet opening region of the inlet passage of the head plate device and at or on the periphery of the outlet opening region of the outlet passage of the storage container device is suitable as far as (i) an engaging operation is possible and (ii) a rotational motion and thereby slippage of the coupled components can be avoided.

However, simple geometric structures keep the underlying manufacturing process and the handling of the product simple and are therefore preferred.

Thus, according to another aspect of the present invention the at least one engaging element is formed as one of (A) a fin element extending axially and/or circumferentially, (B) a slit extending axially and/or circumferentially, (C) an element with one of a polygonal, rectangular, triangular, semicircular and oval cross section in the axial direction each on the respective periphery and extending axially and/or circumferentially.

Although provision of a single engaging element is sufficient for avoiding rotational motion, a plurality of engaging elements may be provided on at least one of the inner periphery and the outer periphery of at least one of the inlet or outlet opening region of at least one of the inlet and the outlet passages of the head plate device and the storage container device. Thereby, the reliability of the handling and of the operation of the underlying mixer and of the dispensing apparatus is enhanced.

Again, the structure and the underlying manufacturing process can be kept simple if each of the plurality of engaging elements is formed with an essentially identical shape. However, this is not mandatory and the engaging elements may be different from each other.

For instance and according to a further embodiment of the present invention, the plurality of engaging elements on a respective periphery of the inlet opening regions of the inlet passages may be formed as a sequence of alternating male and female structures. For instance, the sequence of alternating male or female structures may appear as an undulation or corrugation when be viewed along the symmetry axis of the underlying inlet opening region.

In a further alternative of the mixer of the present invention, individuals of pairs of adjacent engaging elements of the plurality of engaging elements on a respective periphery may be positioned directly adjacent to and in direct contact with each other.

Additionally or alternatively, individuals of pairs of adjacent engaging elements of the plurality of engaging elements on a respective periphery are positioned on a respective periphery, with a gap element between them, formed by a free portion of the respective periphery.

An intended exertion of form-fit, press-fit or force-fit may be achieved based on the shape of the at least one engaging element on the respective periphery of the respective opening region of the respective passage.

Therefore, the shape of a protruding engaging element may provide a tapered configuration with at least one of a reduced height in the radial direction and a reduced width in the circumferential direction, each towards the respective opening region or the opening as such.

In case of a male engaging element, a tapered shape with at least one of a reduced height in radial direction and a reduced width in circumferential direction each towards the respective inlet or outlet opening may be provided.

In analogous manner for a female engaging element, a tapered shape with at least one of an increased depth in radial direction and an increased width in circumferential direction each towards the respective inlet or outlet opening may be provided.

These arrangements advantageously result in a self-alignment of the components during the coupling process in particular if the tapered shape of the cooperating engagement elements is provided by engagement elements with circumferential widths which are not constant in the axial direction.

The provision of the engaging element and in particular its shape and/or its position and orientation on the respective periphery may be used as a mechanical coding in order to define a particular assignment of an inlet passage with its inlet opening region to a certain kind of outlet passage and the respective outlet opening region. Thereby, unintended couplings to certain inlet passages or to certain mixers can be avoided as only cartridges can be coupled to the respective inlet opening which have suitable cooperating and complementary engaging elements at their periphery.

According to a further aspect of the present invention, a cartridge arrangement for a dispensing apparatus for dispensing at least two flowable components is provided, comprising a head plate device designed according to the present invention and at least two storage container devices for receiving or for providing a respective chamber for a respective one of the at least two flowable components, wherein at least one of the storage container devices is designed according to the present invention.

Each of the at least two storage container devices may be filled with material of one of the at least two flowable components.

It is another aspect of the present invention to provide a dispensing apparatus for dispensing at least two flowable components. The dispensing apparatus comprises a cartridge arrangement according to the present invention, i.e. a head plate device for mixing the components and at least two storage container devices for receiving or providing a respective chamber for each component.

The storage container device or the respective chamber has at least one outlet passage for one of the components. The head plate device is designed according to the present invention and as described above. At least one of the storage container devices is designed according the present invention. In addition, the apparatus comprises a mixer device which is attachable or attached to the cartridge arrangement and which is configured for receiving from the cartridge arrangement the at least two flowable components, for mixing the at least two flowable components, and for dispensing the at least two flowable components in a mixed state.

An involved mixer may be a dynamic mixer having a rotatable mixing element or a static mixer having a static mixing element.

According to the present invention, the head plate device according to the present invention, the storage container device according to the present invention, the cartridge arrangement according to the present invention, and the dispensing apparatus according to the present invention may be used for storing, mixing, and/or dispensing at least two flowable components, in particular at least one of a sealant and an adhesive and/or for at least one of installing, fixing, gluing, sealing, and repairing a window, in particular a wind shield or wind screen of a vehicle, in particular in a car.

Further details of the invention will become apparent from a consideration of the drawings and ensuing description.

FIGS. 1A, B are schematic and cross-sectional side-views which demonstrate an embodiment of the head plate device according to the present invention before and in cooperation with storage container devices.

FIG. 1C, D are a schematic and cross-sectional side-views of an embodiment of the head plate device according to the present invention before and in cooperation with a mixer device.

FIGS. 2A, B are cross-sectional side-views which demonstrate an embodiment of a head plate device before and in cooperation with storage container devices, having already attached a mixer device.

FIGS. 3A, B provide different views of a further embodiment of a head plate device according to the present invention.

FIG. 4 is a cross-sectional side-view of a detail of the head plate device showing in enlarged form one of the inlet passages.

FIGS. 5A-E provide different views of a storage container device according to the present invention.

FIGS. 6-8 present different views of designs for inlet and outlet opening regions according to the present invention.

FIGS. 9A-F are cross-sectional side-views elucidating possible shapes of engaging elements used in the present invention.

FIGS. 10A-D demonstrate by means of schematic and cross-sectional side-views different designs for connecting inlet opening regions and outlet opening regions assigned to each other.

FIGS. 11A-B are schematic front views elucidating different arrangements of plurality of male engaging elements on an outer periphery of an inlet or outlet passage.

FIG. 12A-D are schematic side-views demonstrating different arrangements of pluralities of engaging elements on outer peripheries of an inlet or outlet passage.

In the following, embodiments of the invention are described. All described embodiments in the following and their properties and technical features may be combined in any way, i.e. there is no limitation that certain described embodiments, properties and technical features may not be combined with others.

The same reference symbols in the figures describe the same or equivalent components, even if a detailed description is not repeated for each occurrence thereof.

In the following, reference is taken to the figures in detail. The trihedrons shown in the figures elucidate the position and the orientation of the respective components and portions of the head plate device 45, of the storage container device 90, of the cartridge arrangement 100, and of the dispensing apparatus 1 according to the present invention with respect to each other and in relation to space, in particular when compared between the different views of the figures.

Figure 1A:
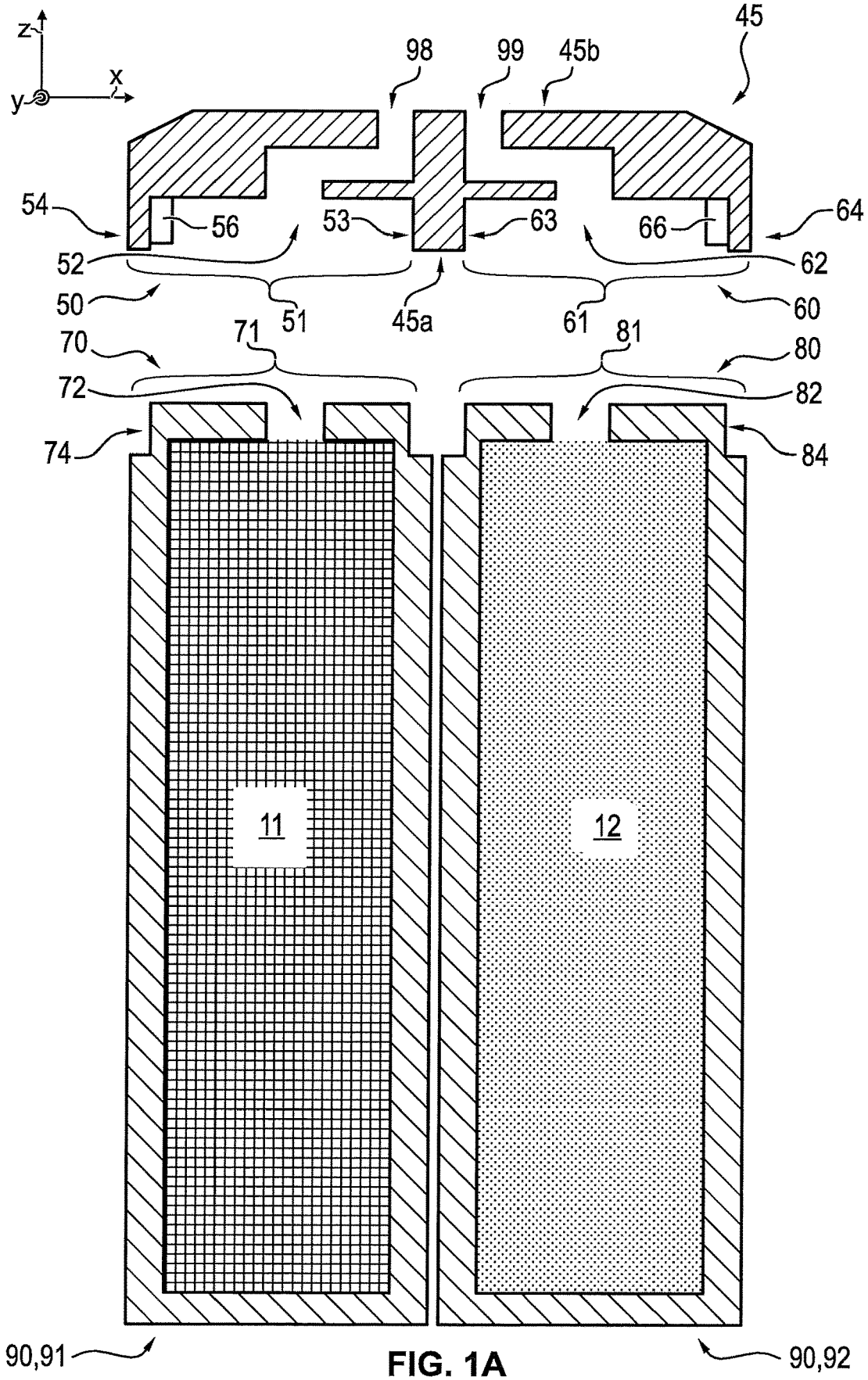
FIGS. 1A and 1B are schematic and cross-sectional side-views of an embodiment of a head plate device 45 according to the present invention before and in cooperation with respective storage container devices which may be formed according to the present invention.
Figure 1B:
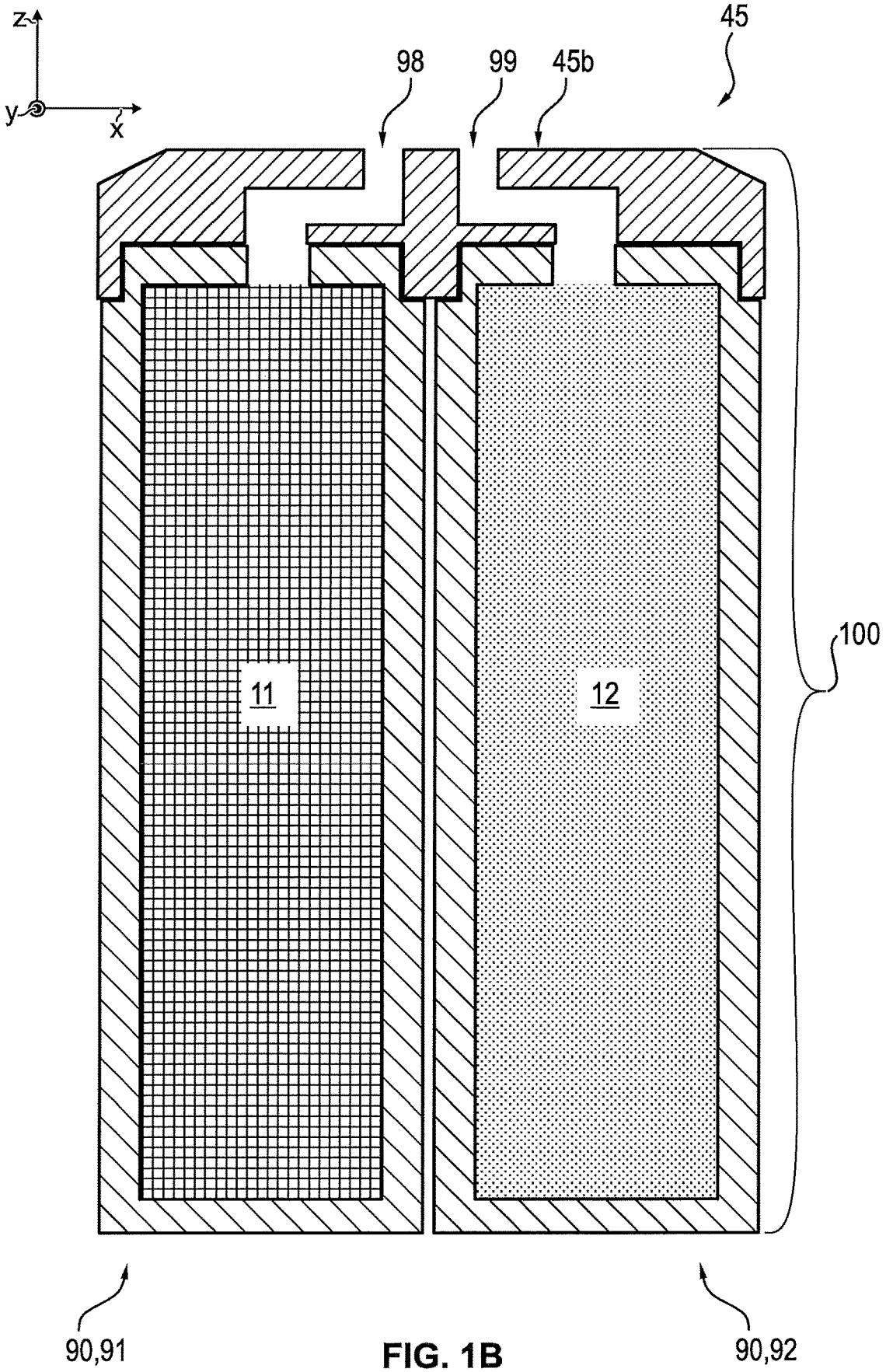
Figure 1C:
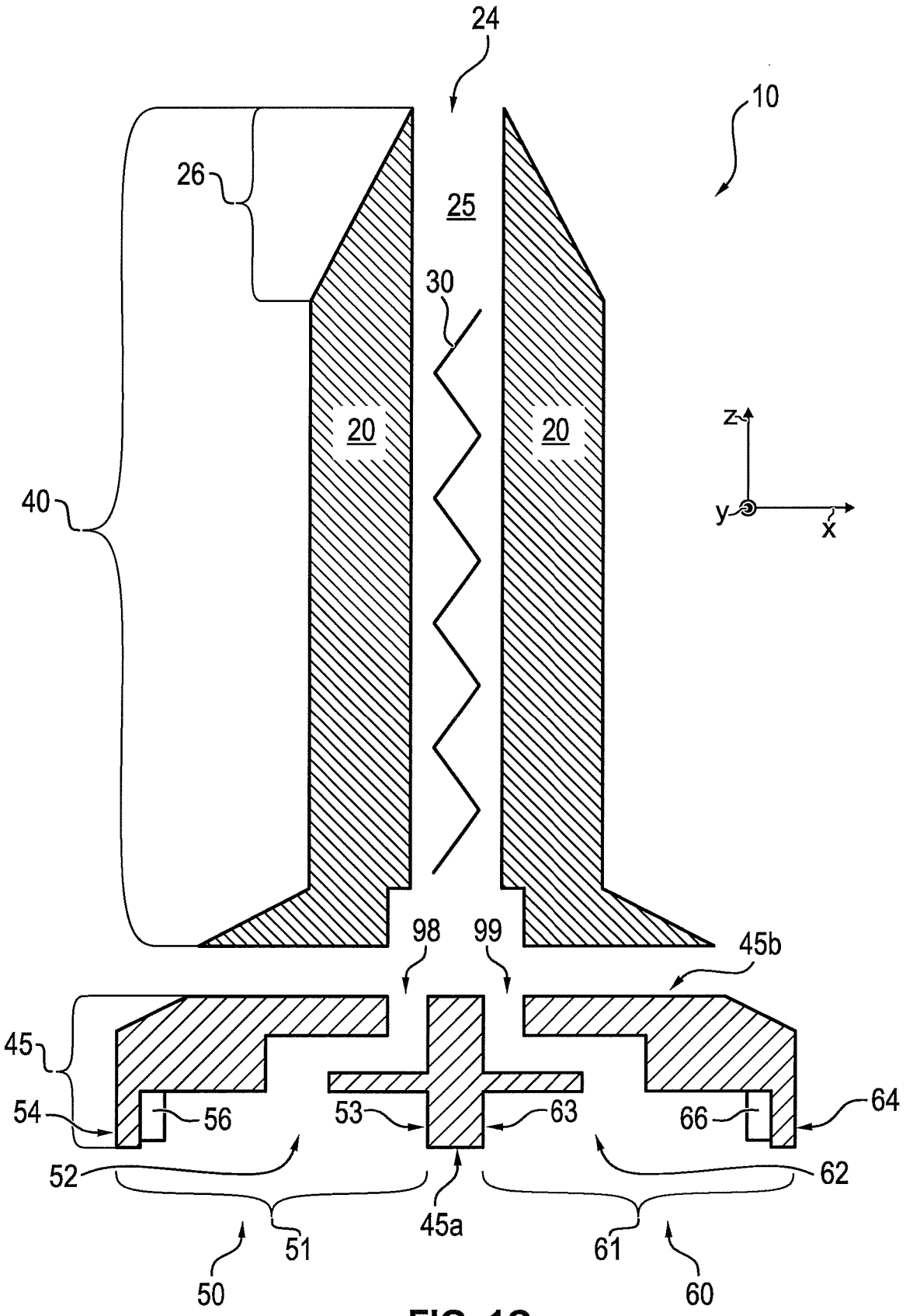
FIGS. 1C and 1D are schematic and cross-sectional side-views of an embodiment of a head plate device 45 according to the present invention before and in cooperation with a mixer or mixer device 10.
Figure 1D:
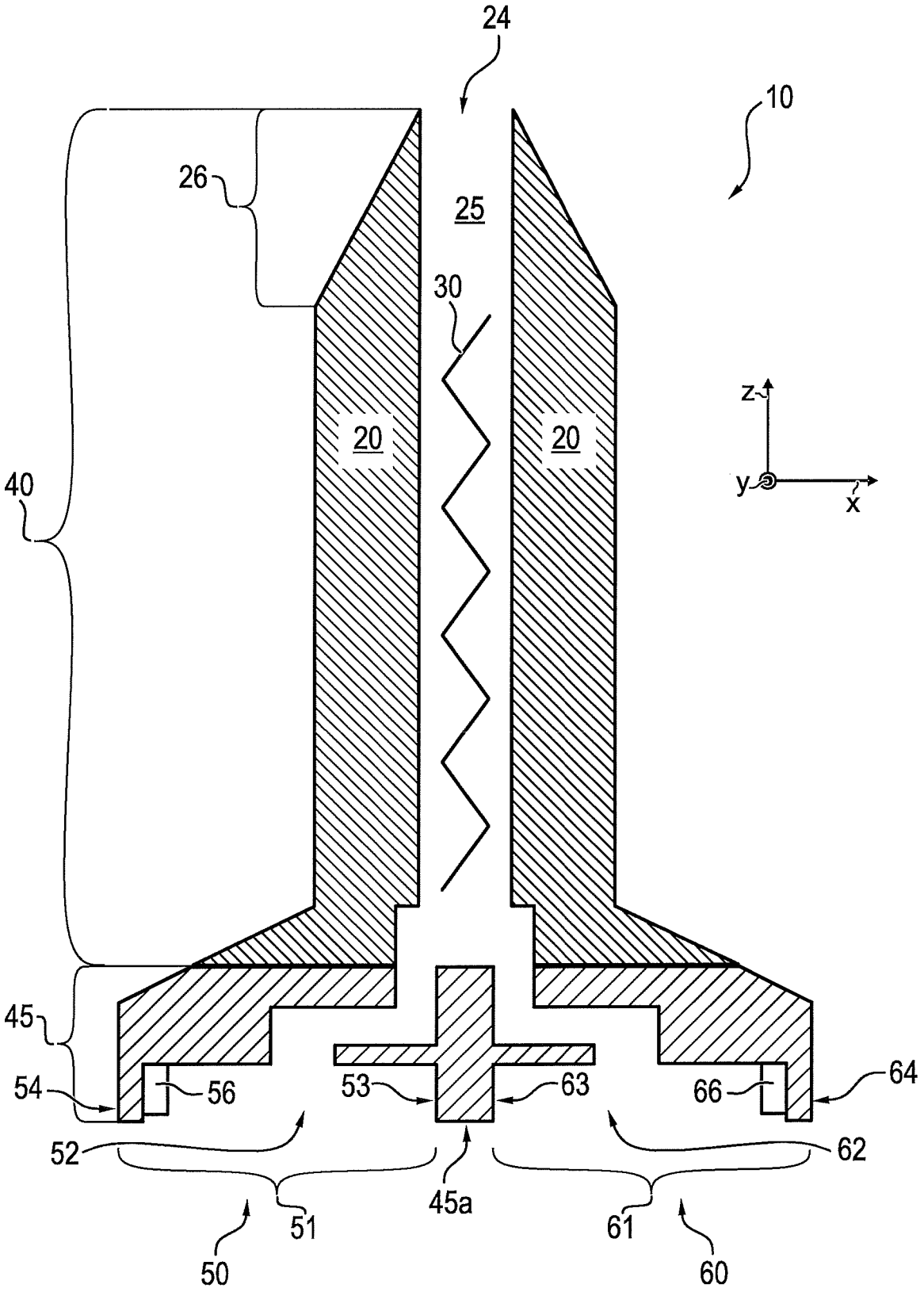

The mixer device 10 is formed by a mixer housing 20 which comprises in an upper part in FIGS. 1C, D a mixing part or portion 40 and in the lower part of FIG. 1C, D an intermediate part or portion 45. The mixing part 40 of the housing 20 comprises in its interior 25 a mixing element 30. This mixing element 30 may be or form a static mixer or a dynamic mixer. In the top portion of FIG. 1C, D it is shown that the mixer housing 20 forms a tip or tip portion 26 with an outlet opening 24 for dispensing the mixture formed within the interior 25 of the mixer device 10 by mixing the at least two flowable components 11, 12.

Here the shown head plate device 45 is configured for being coupled on its second or upper side 45*b* with the mixer device 10; thus, respective engaging elements—as for the attachment of the cartridge container devices 90—or cooperating threadings or any other means be provided.

The shown head plate device 45 is configured for being coupled on its first or lower side 45*a* with a plurality of storage container devices 90 offering respective storage chambers 91, 92 which are not shown here.

Therefore, the head plate 45 comprises first and second inlet passages 50 and 60, respectively, which are separated from each other and which—after attachment of the mixer device 10—may join into the interior 25 or mixing passage 25 of the mixer device 10 where the mixing element 30 is situated.

The lower part of the head plate device 45 forms the first and second inlet opening regions 51 and 61, respectively, with its first and second inlet openings 52 and 62, respectively. The first and second inlet opening regions 51 and 61 comprise inner and outer peripheries 53, 63 and 54, 64, respectively.

In the embodiment shown in FIGS. 1A to 1D, each inner periphery 53 and 63 comprises an engaging element 56, 66 which—in this particular case—protrudes from the inner periphery 53, 63 radially inside. Moreover, a first end of the engaging elements 56, 66 facing in the direction of the head plate device 45, contacts the head plate device 45, whereas a second end facing the in the direction of the respective storage container device 90, is free so that it can be inserted into a corresponding element on the storage container device 90. Thereby, the engaging elements 56, 66 block a rotation between the head casing device and the respective storage container device 90 but allow an axial movement between these two parts.

The first and second inlet opening regions 51, 61 and the respective openings 52, 62 have a circular or circular cylindrical geometry which in this particular case is given by a symmetry axis which is parallel to the symmetry axis of the mixer 10 as such.

In the case shown in FIGS. 1A to 1D, two inlet opening regions 51, 61 are provided, therefore, the mixer 10 of FIGS. 1A to 1D is adapted for being used with two storage container devices 90 offering storage chambers 91, 92. However, the number of two storage container devices 90 and therefore the number of two inlet openings 51, 61 is not mandatory as this situation demonstrates the minimum only. At least two inlet openings 51, 61 for two storage container devices 90 to be connected thereto have to be provided.

Figure 2A:
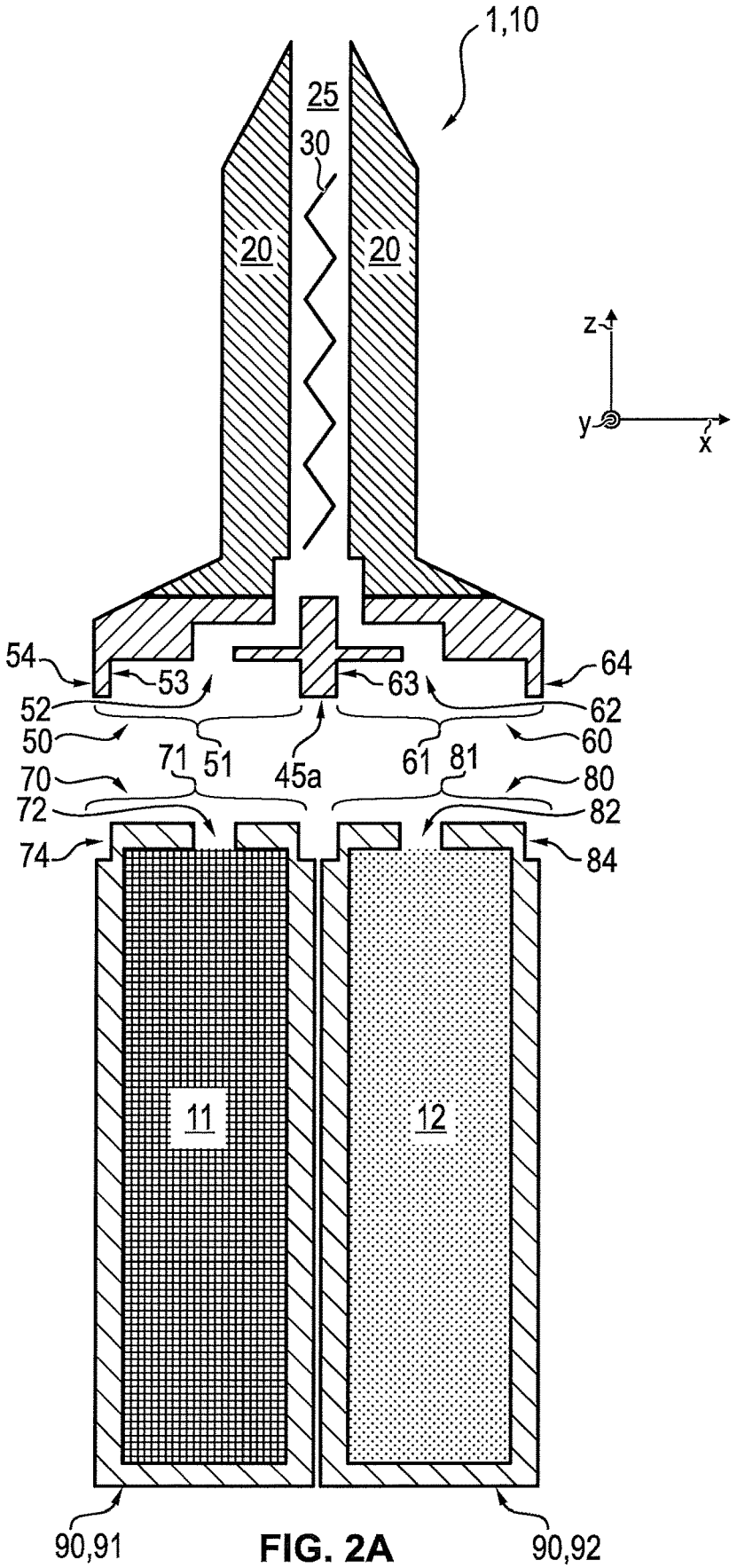
Figure 2B:
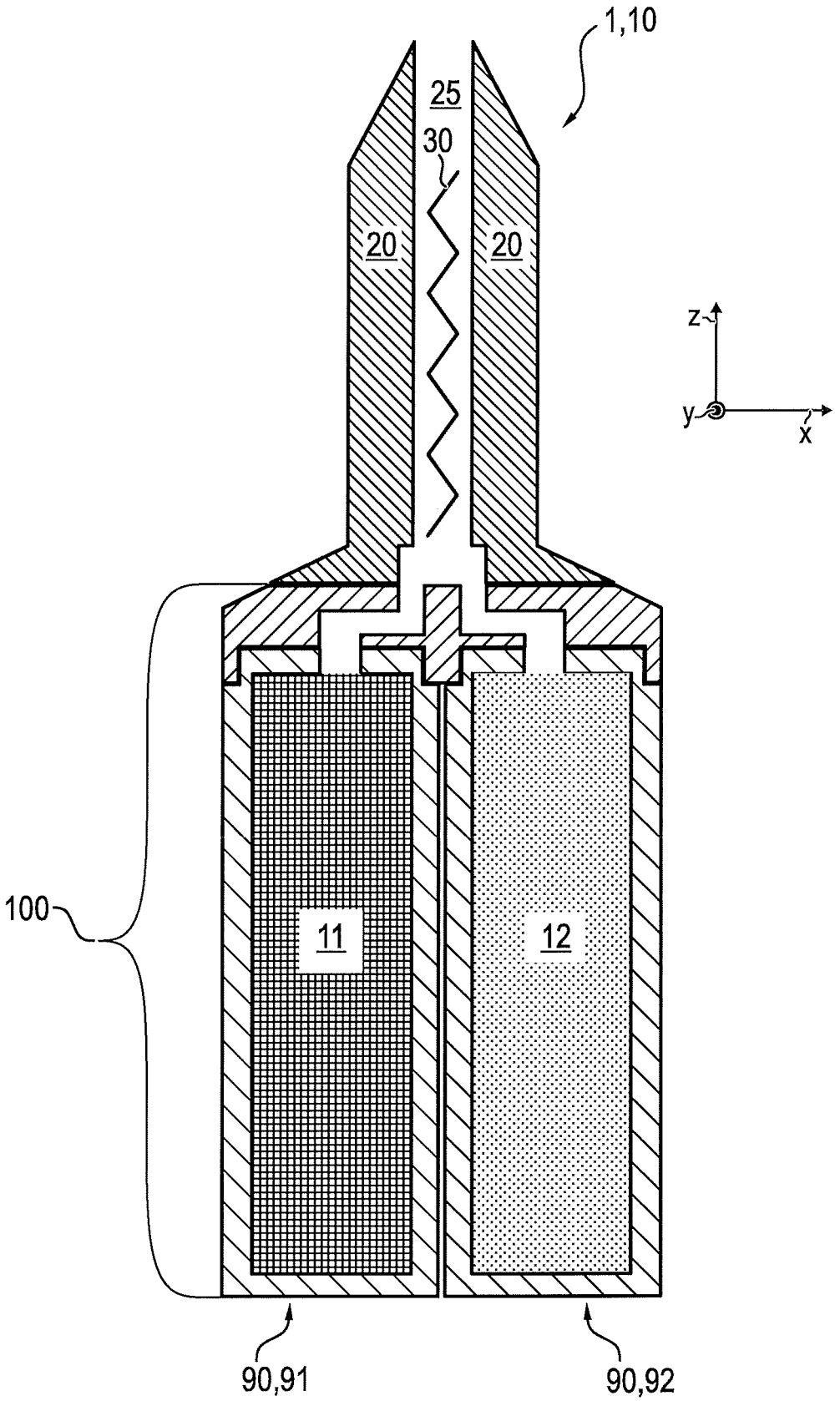

FIGS. 2A and 2B demonstrate the usage of the head plate device 45, the mixer device 10, and the storage container devices 90 of FIGS. 1A to 1D in cooperation, wherein the two storage container devices 90 offer, provide or receive storage chambers 91 and 92. FIGS. 2A and 2B describe situations before and after having attached the storage container devices 90 with its outlet passages 70 and 80 to the inlet passages 50 and 60 presented by the head plate device 45.

Each of the storage container devices 90 and the offered storage chambers 91 and 92 are designed in order to store in their interior a first flowable component 11 and a second flowable component 12, respectively. In addition, the storage container devices 90 and in particular their outlet passages 80 and 90 are configured to cooperate with the inlet passages 50 and 60, respectively, of the mixer device 10 and in particular to have means for engaging with the engaging elements 56 and 66 formed on the inner periphery 53, 63 of the first and second inlet opening regions 51 and 61 of the mixer device 10.

Therefore, the outlet passages 70 and 80 of the storage container devices 90 in their outlet opening regions 71, 81 comprise—at suitable locations—respective engaging elements 76, 86 which are not shown in FIGS. 2A and 2B and which are essentially complementary to some extent to the underlying engaging element 56 and 66 located at the first and second inlet opening regions 51 and 61 of the head plate device 45.

The engagement of the engaging elements 56, 76 on the one hand and 66, 86 on the other hand ensure a torque-free and rotation-free positioning and cooperation of the storage container devices 90 and the offered first and second storage chambers 91, 92 with their first and second outlet passages 70 and 80 in or at the respective first and second inlet passages 50 and 60 of the mixer device 10 in order to enable a reliable operation of the dispensing apparatus 1 according to the present invention.

Alternatively or additionally, an axial movement between the head plate device 45 and the storage container devices 90 may be suppressed in order to reduce the risk of inadvertently losing the attachment between these components; this may be achieved by the same or by different engaging elements 56, 66, 76, 86, 96, 97.

Figure 3A:
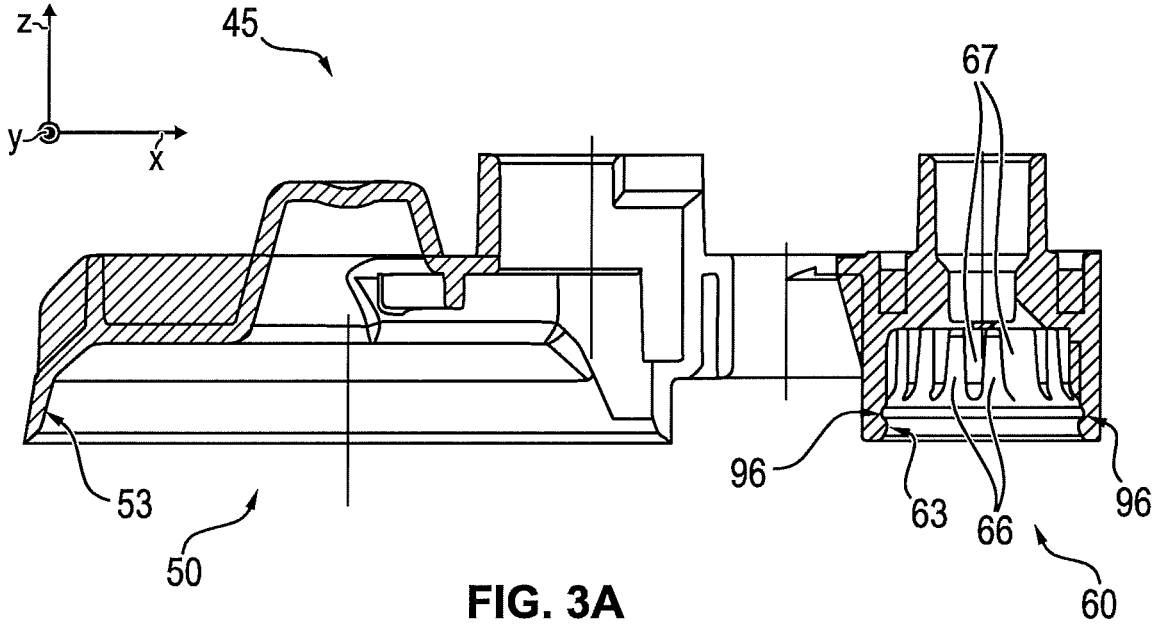
Figure 3B:
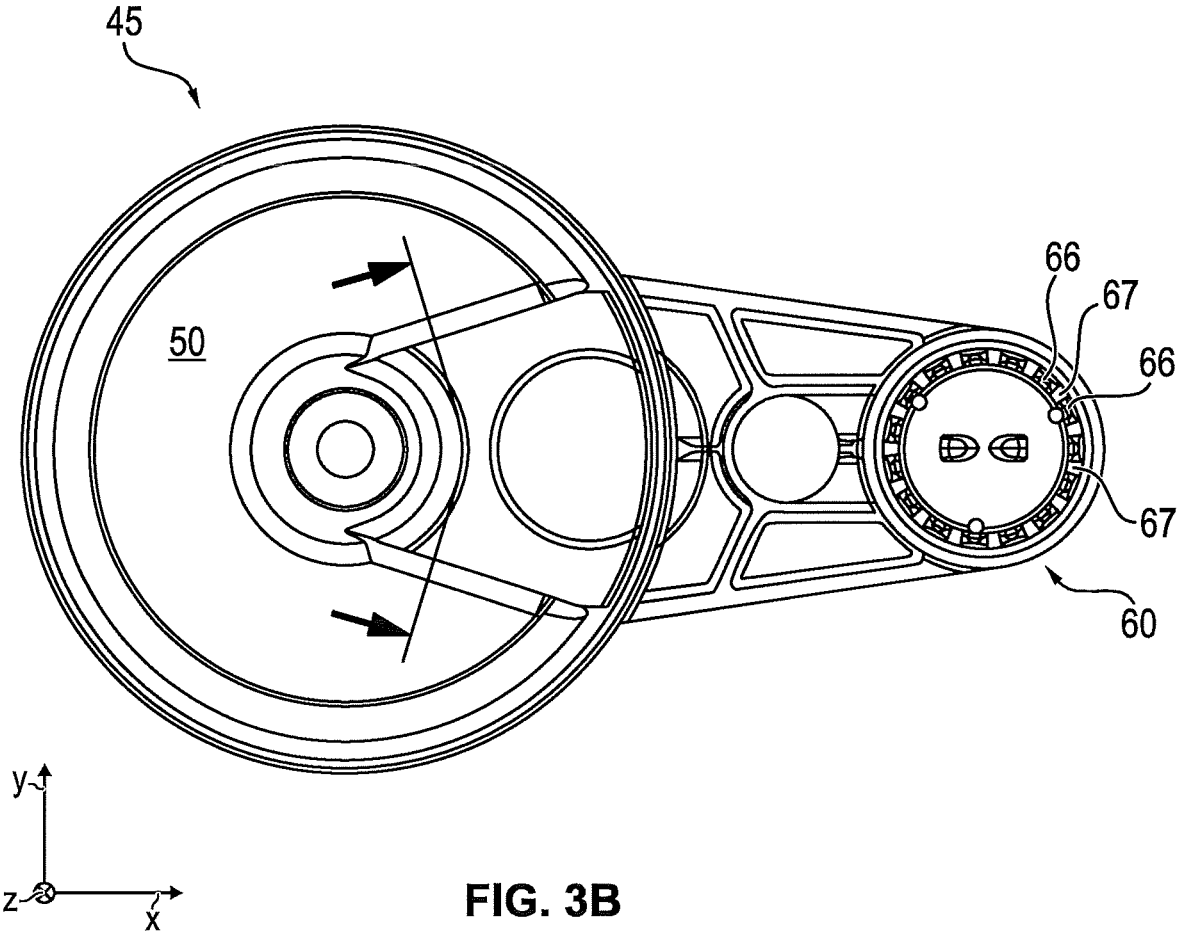

FIGS. 3A and 3B show different views of a head plate device according to the present invention 45 and functioning as an intermediate portion between the mixer device 10 and the storage container devices 90 in a dispensing apparatus 1 according to the present invention.

FIG. 3A gives a schematic and cross-sectional side-view, FIG. 3B gives a schematic plan view from below.

FIGS. 3A and 3B show the provision of a plain first inlet passage 50, i.e. an inlet passage without having any engaging element. The second inlet passage 60 is provided with a plurality of first engaging elements 66 which are formed as a sequence of circumferentially arranged recesses on an inner periphery 63 of the second inlet opening region 61 of the second inlet passage 60.

Between the recesses as engaging elements 66 separating gap elements 67 are provided, i.e. regions where no engaging element 66 is located at or on the inner periphery 63 and where the inner periphery 63 of the second inlet passage 60 is left unchanged. Under such circumstances, the sequence of engaging elements 66 with gap elements 67 therebetween resembles a crown-like structure.

The first engaging elements 66 yield a torque-free attachment to a respective storage container device 90 to the head plate device 45.

In addition, a second engaging element 96 is provided which is formed as an annular recess running around the inner periphery 63 of the second inlet opening region 61 of the second inlet passage 60.

The second engaging element 96 yields suppression of axial movement between of the attached storage container device 90 with respect to the head plate device 45. This is elucidated in more detail in connection with FIGS. 5D and 5E.

Towards the inlet opening 62 of the inlet opening region 61 the engaging elements 66 extend in a tapered manner with an increasing width in the circumferential direction. This can also be seen in more detail in FIG. 4 described below.

Figure 4:
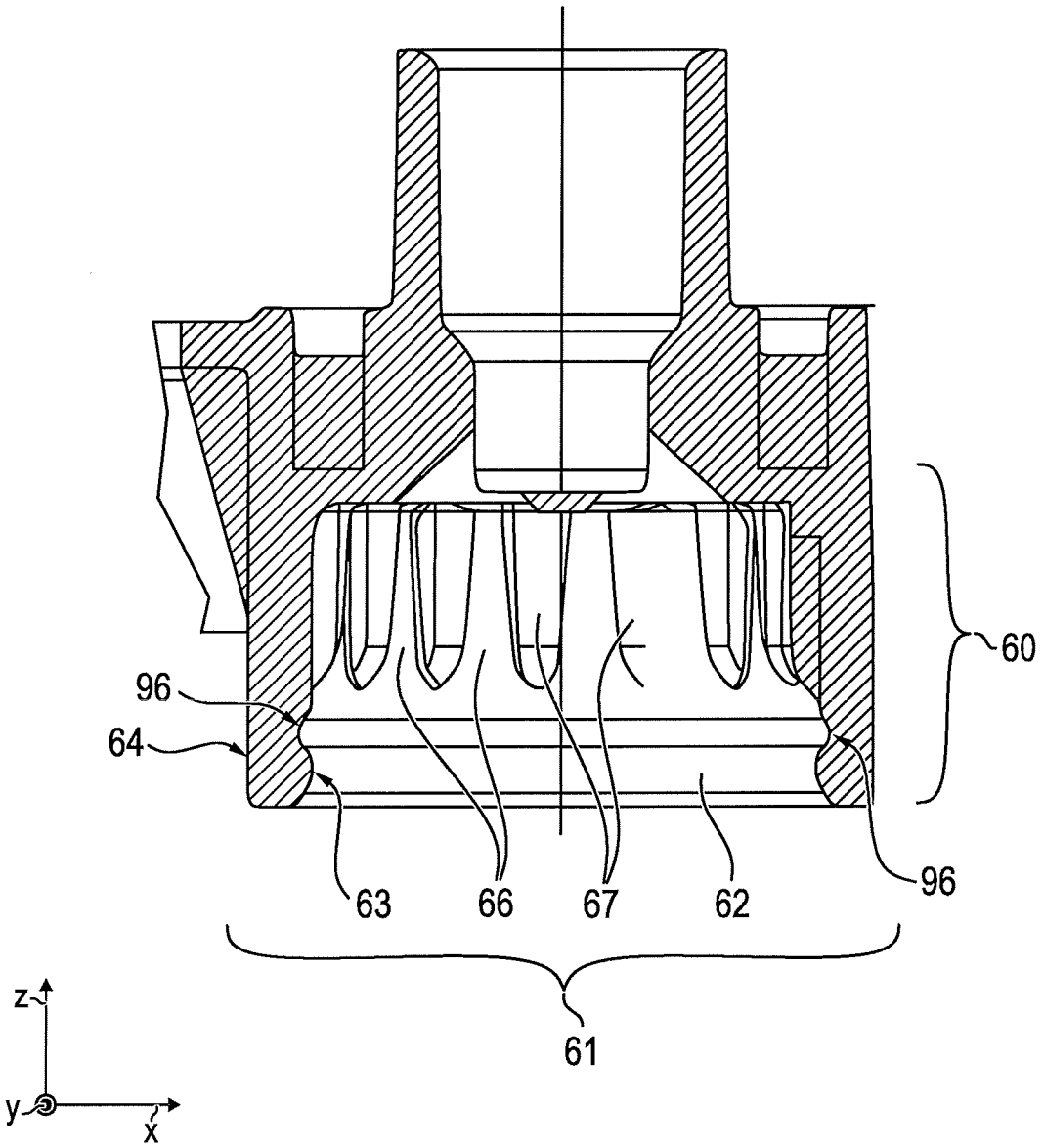

FIG. 4 shows in more detail and in enlarged form the second inlet passage 60 with its second inlet opening region 61 and its second inlet opening 62 as such, wherein at the inner periphery 63 of the second inlet opening region 61 the alternating sequence of recesses as engaging elements 66 is shown which recess from the inner periphery 63 radially inwardly into the inner periphery 63. Gap elements 67 are also shown.

In connection with the embodiments shown in FIGS. 3A, 3B, and 4, an application in the field of storing, mixing, and/or dispensing at least two flowable components, in particular at least one of a sealant and an adhesive and/or for at least one of installing, fixing, gluing, sealing, and repairing a window, in particular a wind shield or wind screen of a vehicle, in particular in a car is supported.

For instance, inlet passage 60 shown in FIG. 4 and in FIGS. 3A and 3B on right hand side may be configured for having attached by click into place action a first storage container 90 comprising an reaction accelerator—e.g. water—and the other inlet passage 50 shown on the left hand side of FIGS. 3A and 3B may be configured for having attached thereto a second storage container 90, e.g. being formed as a sausage bag to be attached by glueing.

Thus, cartridge arrangement 100 shown in FIGS. 1A to 1D, may be such, that a filled small cartridge as a storage container device 90 is clicked into the head plate 45 on the right hand side seen in FIGS. 3A, 3B and 4. In addition The sausage bag as a second storage container device 90 is glued into the head plate 45 on the other (larger) side shown on the left of FIGS. 3A and 3B. This will may be a product for an any end user. Just before using it, the user will insert the cartridge into a dispensing apparatus 1 also by attaching mixer device 10.

Figure 5A:
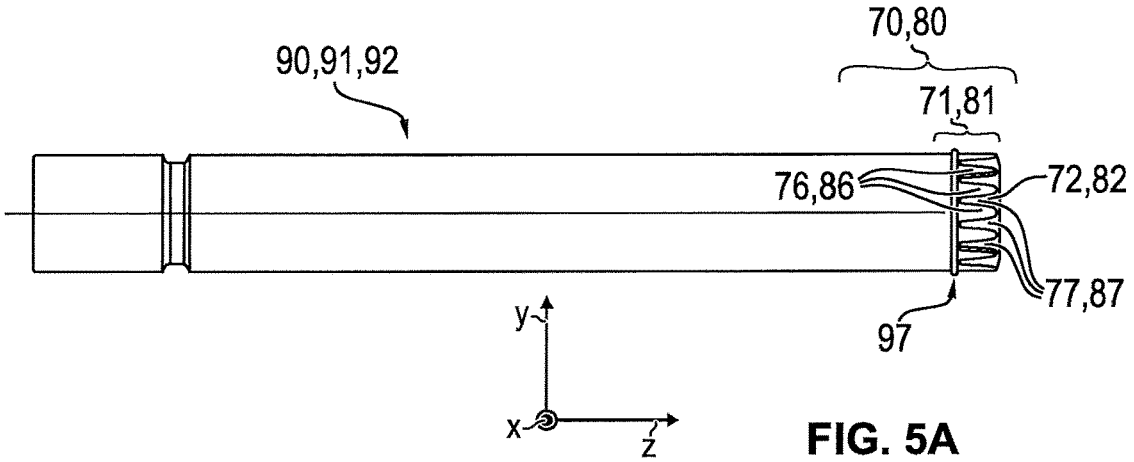
Figure 5B:
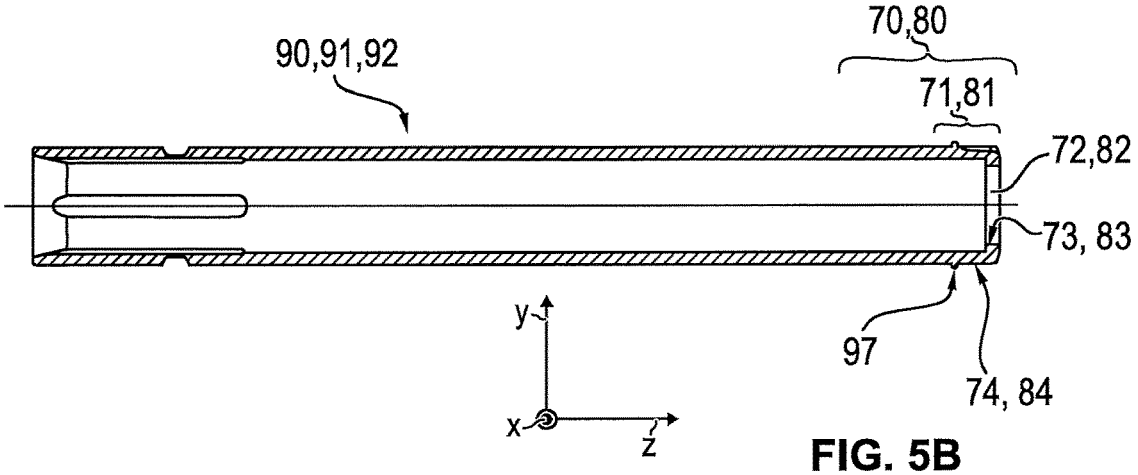
Figure 5C:
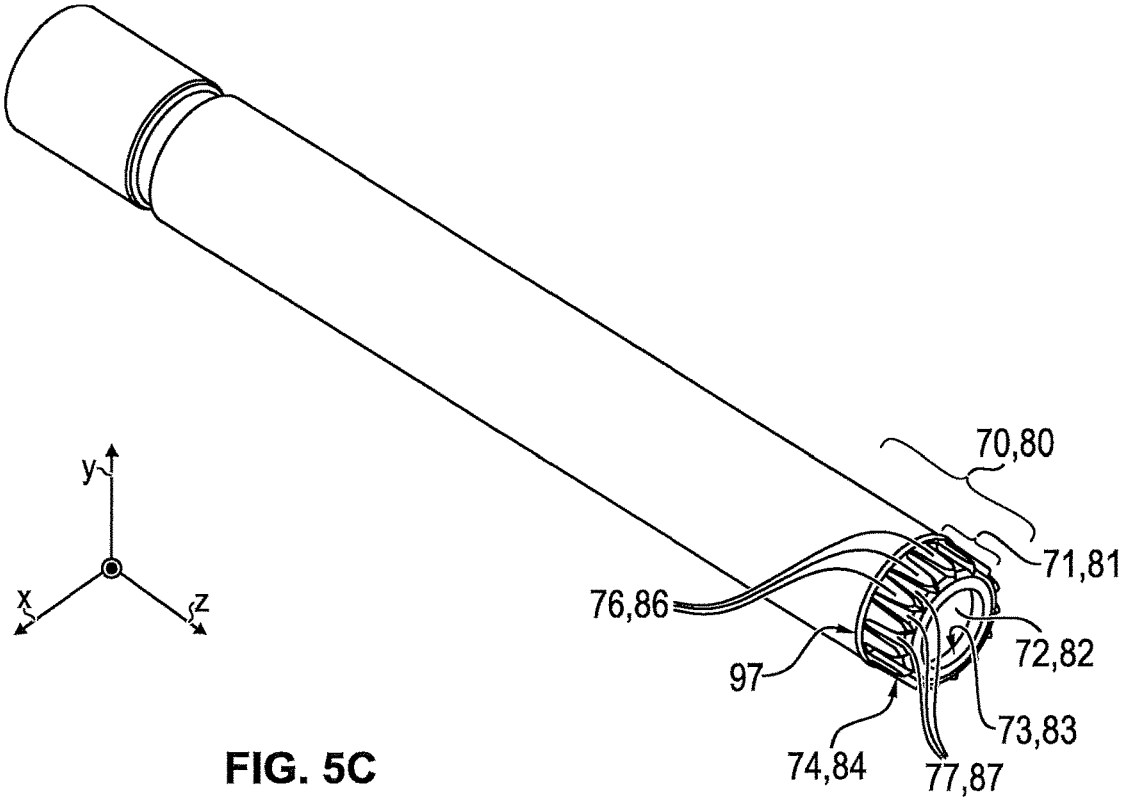

FIGS. 5A to 5C give a schematic side-view, a schematic cross-sectional side-view and a perspective and three-dimensional side-view from above, respectively, showing an embodiment of a storage container device 90 according to the present invention and offering a storage chamber 91, 92.

The storage container device 90 described in FIGS. 5A to 5C is formed by a cylindrical tubular member forming a storage chamber 91, 92 for a respective first or second flowable component 11, 12. The first and second components are not indicated in these Figures. At the right-hand side in FIGS. 5A to 5C the storage container device 90 shows a first/second outlet passage 70, 80 with respective first/second outlet opening region 71, 81 terminating in a respective first/second outlet opening 72, 82.

Figure 5D:
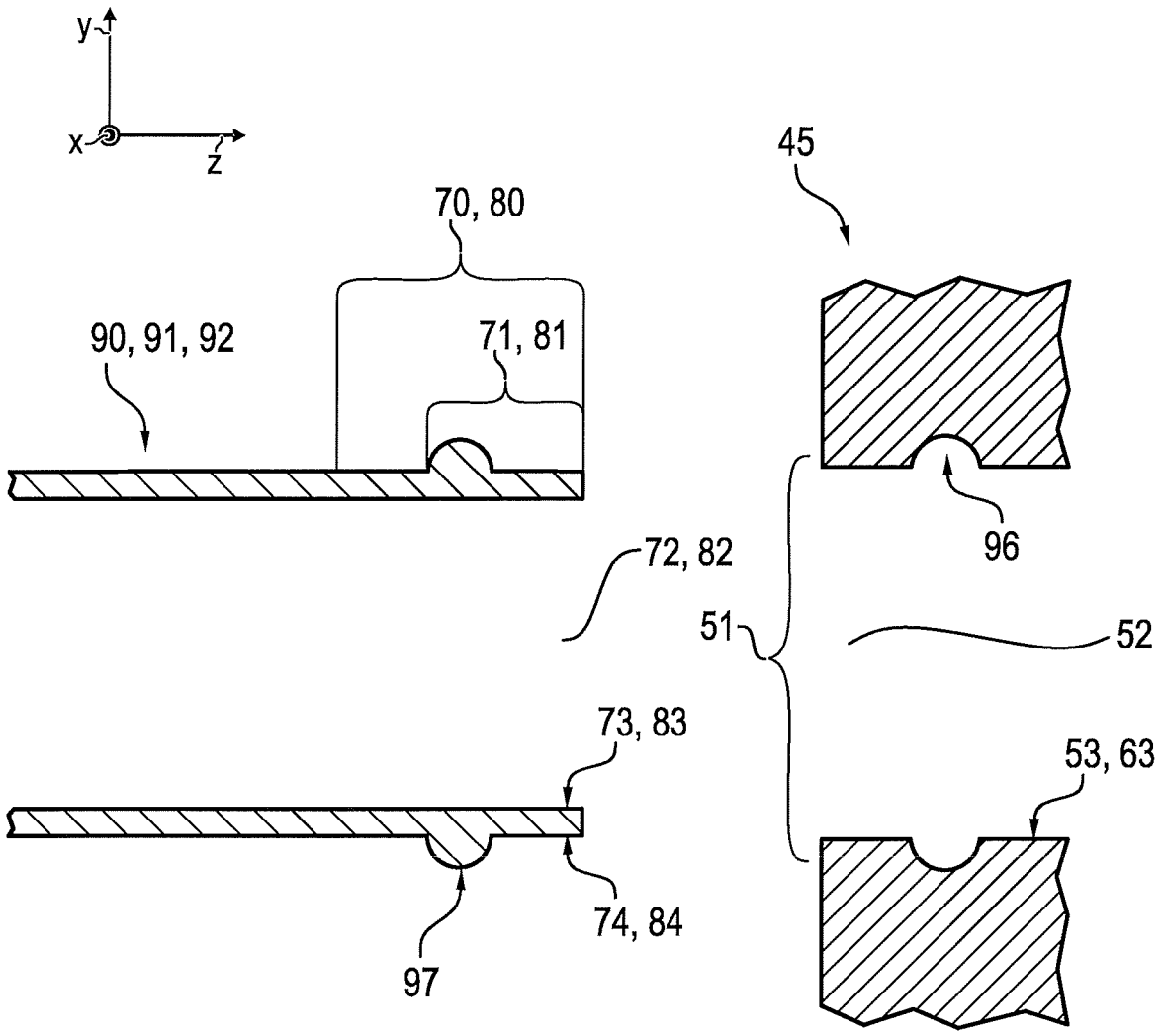
Figure 5E:
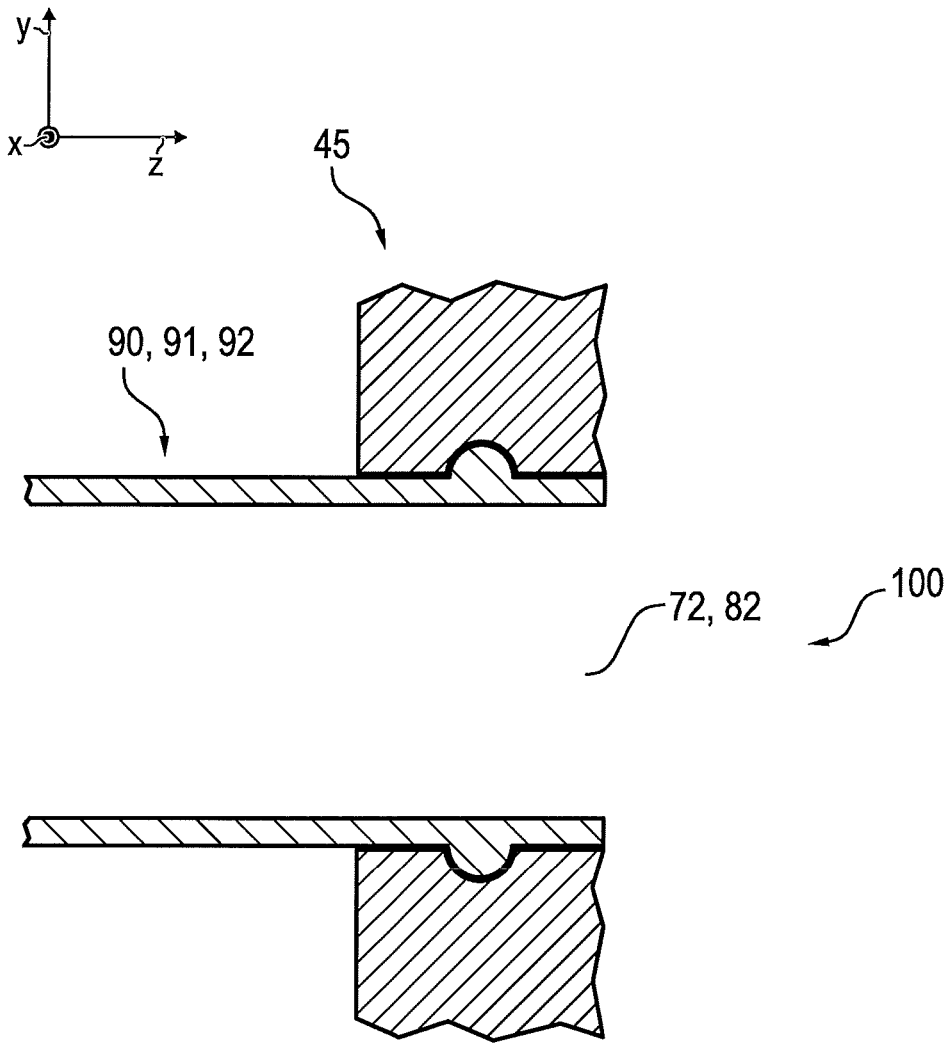

FIGS. 5D and 5E elucidate in more detail the so called a snap, lock, latch, or click into place action for attaching a cartridge container device 90 having as an engaging element 97 an annular rim running on the outer periphery 74, 84. Accordingly, the corresponding inner periphery 53, 63 of head plate device 45 has as an engaging element 96 an annular recess 96 running on or within said inner periphery 53, 63. Engaging element 96 and 97 have complimentary shapes in order to achieve cooperation and the required snap, lock, latch, or click into place action for attaching the cartridge container device 90 to the head plate.

Elasticity and/or a resilient nature of one or both of the cooperating engaging elements 96 and 97 might be helpful, too, for supporting their action.

In complementary correspondence to the arrangement of the inlet passage 60 shown in FIGS. 3A, 3B and 4 of the head plate device 45, the outer periphery 74, 84 of the outlet passage 70, 80 of the storage container device 90 comprises male protruding engaging elements 76, 86 which protrude outwardly from the outer periphery 74, 84, whereas the inner periphery 73, 83 does not carry any engaging element.

FIGS. 6 and 7A to 7D as well as 8 elucidate different aspects of the geometry, the orientation and the position of an engaging element 56, 66, 76, 86 with respect to the inner periphery 53, 63, 73, 83 or outer periphery 54, 64, 74, 84 of a first/second inlet/outlet passage 50, 60, 70, 80 and its first/second inlet/outlet opening region 51, 61, 71, 81 and its respective first/second inlet/outlet opening 52, 62, 72, 82. Each of the inlet and/or outlet passages 50, 60, 70, 80 has an essentially circular geometry with a symmetry axis A.

The embodiments of FIGS. 6 and 7A to 7D as well as 8 all apply to inlet passages 50, 60 of a head plate device 45 and to outlet passages 70, 80 of a storage container device 90.

Figure 6:
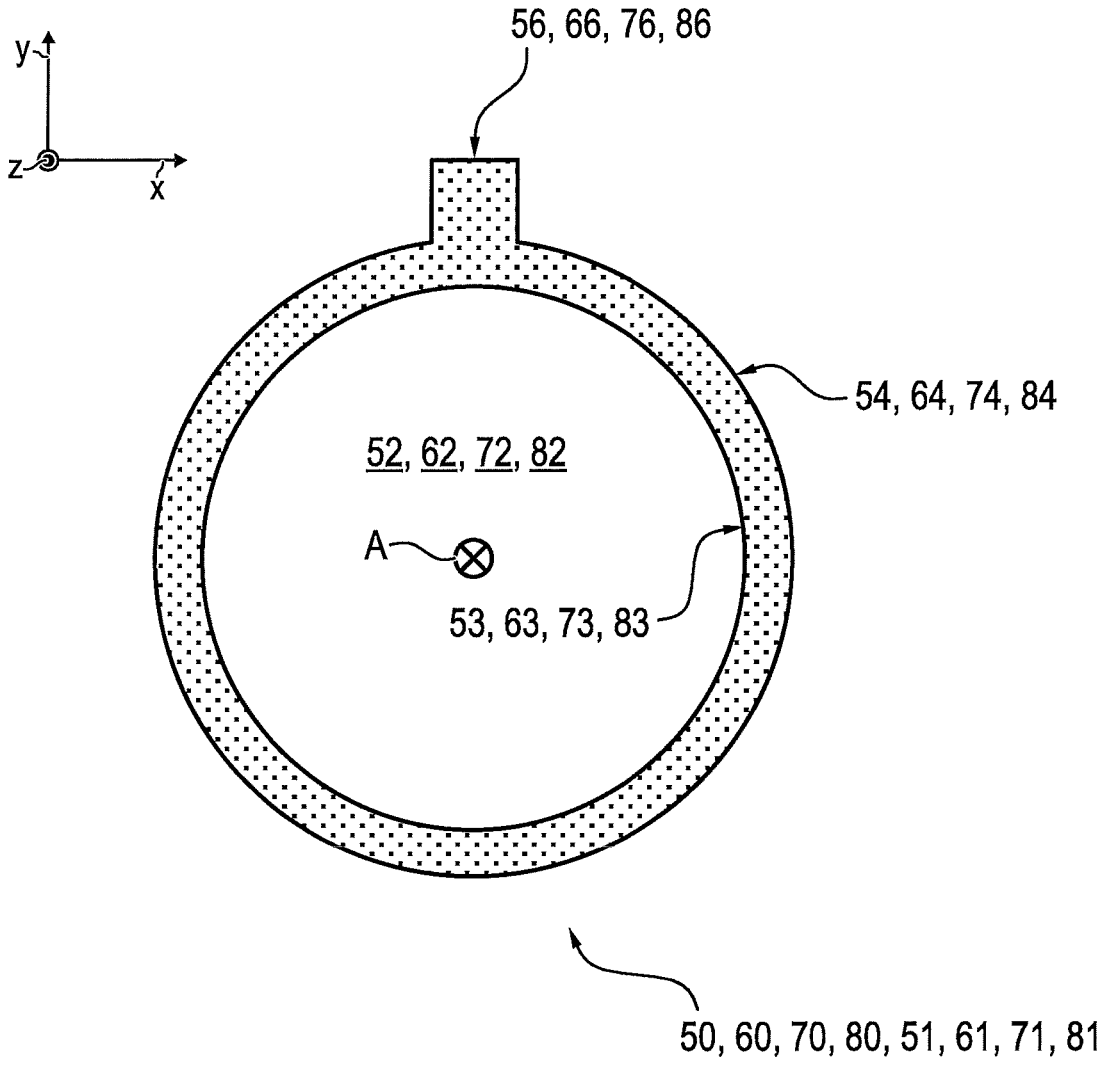
Figure 7A:
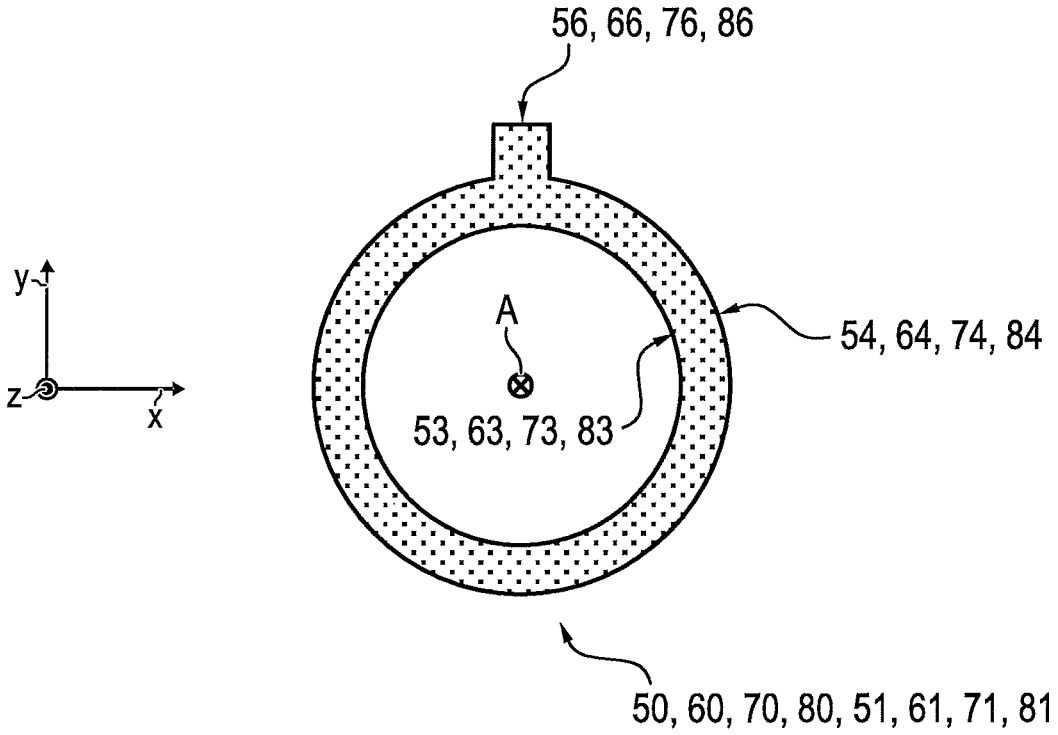

In the embodiments shown in FIGS. 6 and 7A, the provided engaging element 56, 66, 76, 86 is formed as a protrusion on the outer periphery 54, 64, 74, 84 of the respective opening region 51, 61, 71, 81. The protrusion protrudes from the outer periphery 54, 64, 74, 84 outwardly away from the symmetry axis A.

Figure 7B:
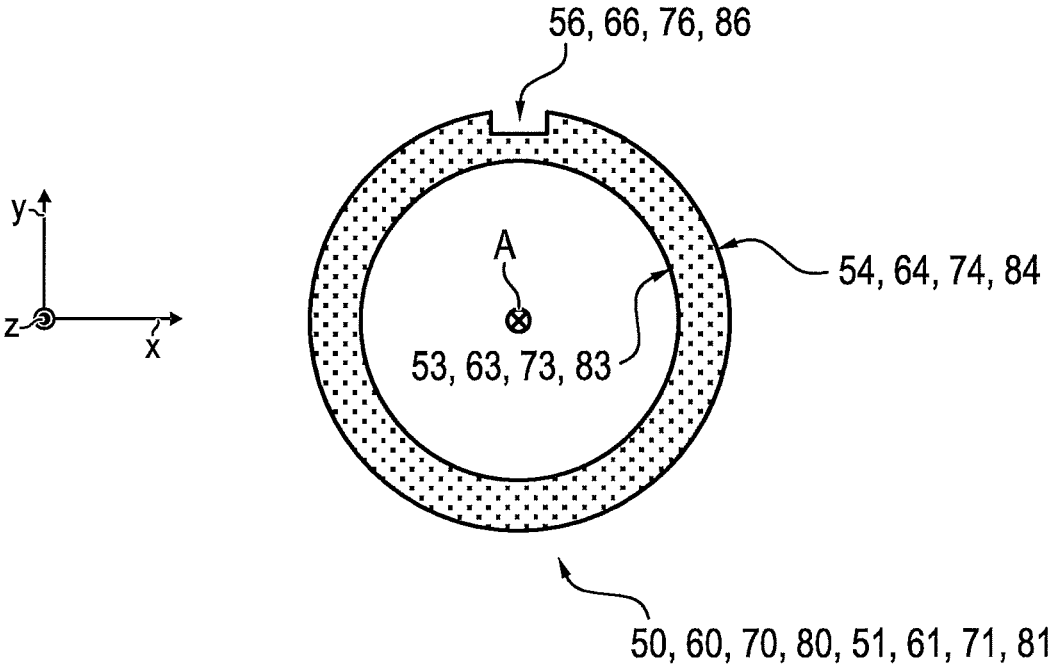
Figure 7C:
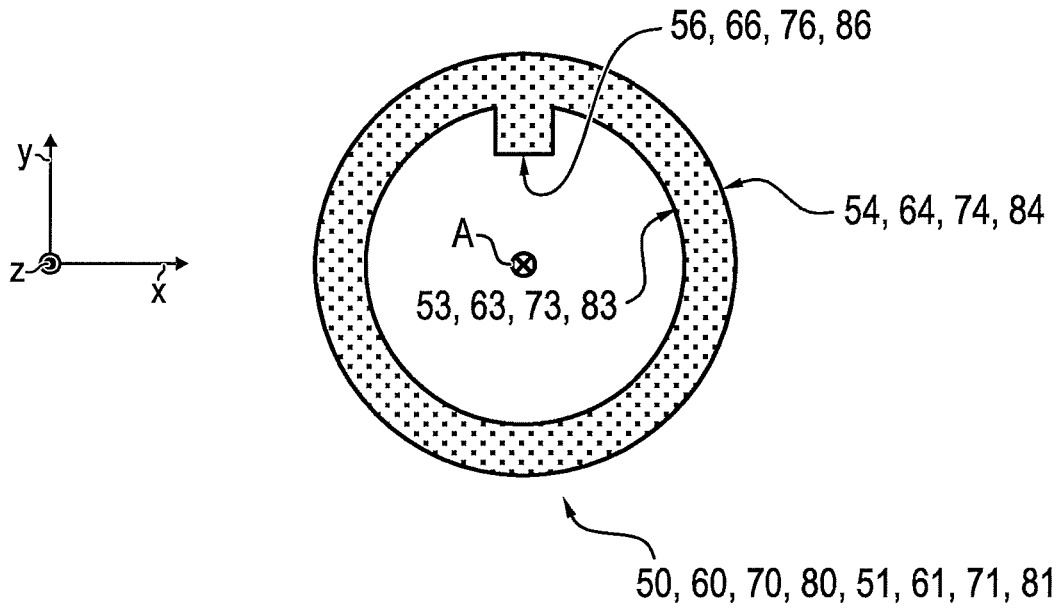

In the embodiment shown in FIG. 7C the engaging element 56, 66, 76, 86 is formed as a male protrusion on the inner periphery 53, 63, 73, 83 protruding radially inwardly toward the symmetry axis A.

Figure 7D:
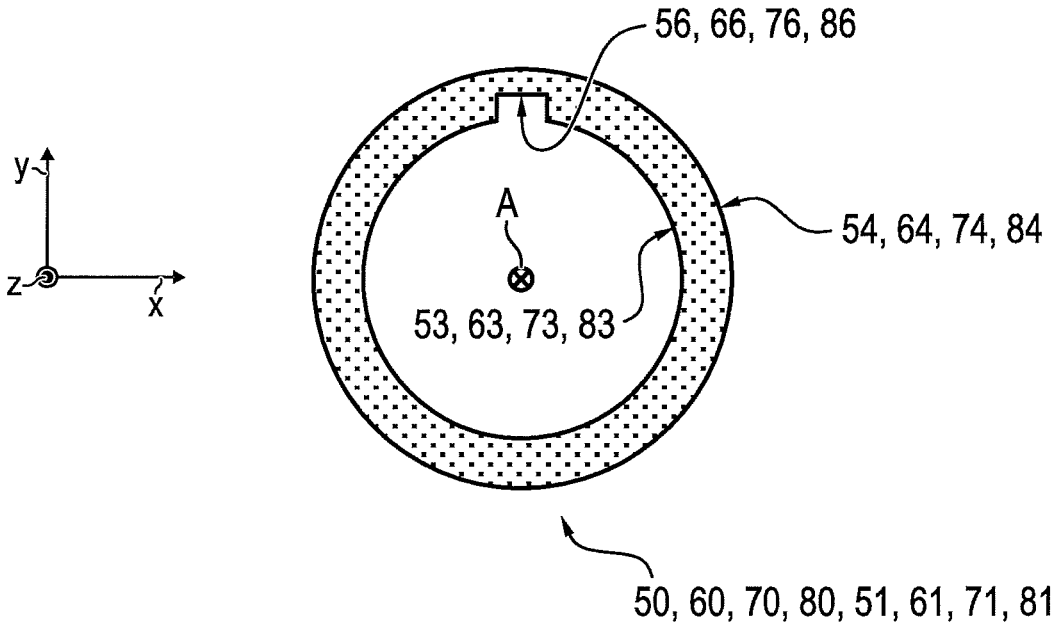

In the embodiments shown in FIGS. 7B and 7D female recesses are provided as engaging elements 56, 66, 76, 86, either recessing from the inner periphery 53, 63, 73, 83 radially outwardly away from the symmetry axis A and on outer periphery 54, 64, 74, 84 radially inwardly towards the symmetry axis A.

It should be noticed that the provision of a single engaging element 56, 66, 76, 86 on each of the coupling elements of the mixing device and the storage container device, respectively, is already sufficient for realizing one principle underlying the present invention, namely to ensure a torque-free and rotation-free coupling of an inlet passage 50, 60 of a head plate device 45 to an outlet passage 70, 80 of a storage container device 90 to thereby avoid rotational motion between them and thus the risk of losing the connection to the storage container device 90 in the coupled state and in particular during the mixing and dispensing operation. However, the provision of a plurality of engaging elements arranged in the circumferential direction of the respective coupling element enhances reliability of the structure during operation. Further in a case in which the engagement elements are arranged in a regular manner, an easier connection process is ensured, since more than one circumferential orientation is possible between the head plate device 45 and the storage container device 90 during coupling.

Figure 8:
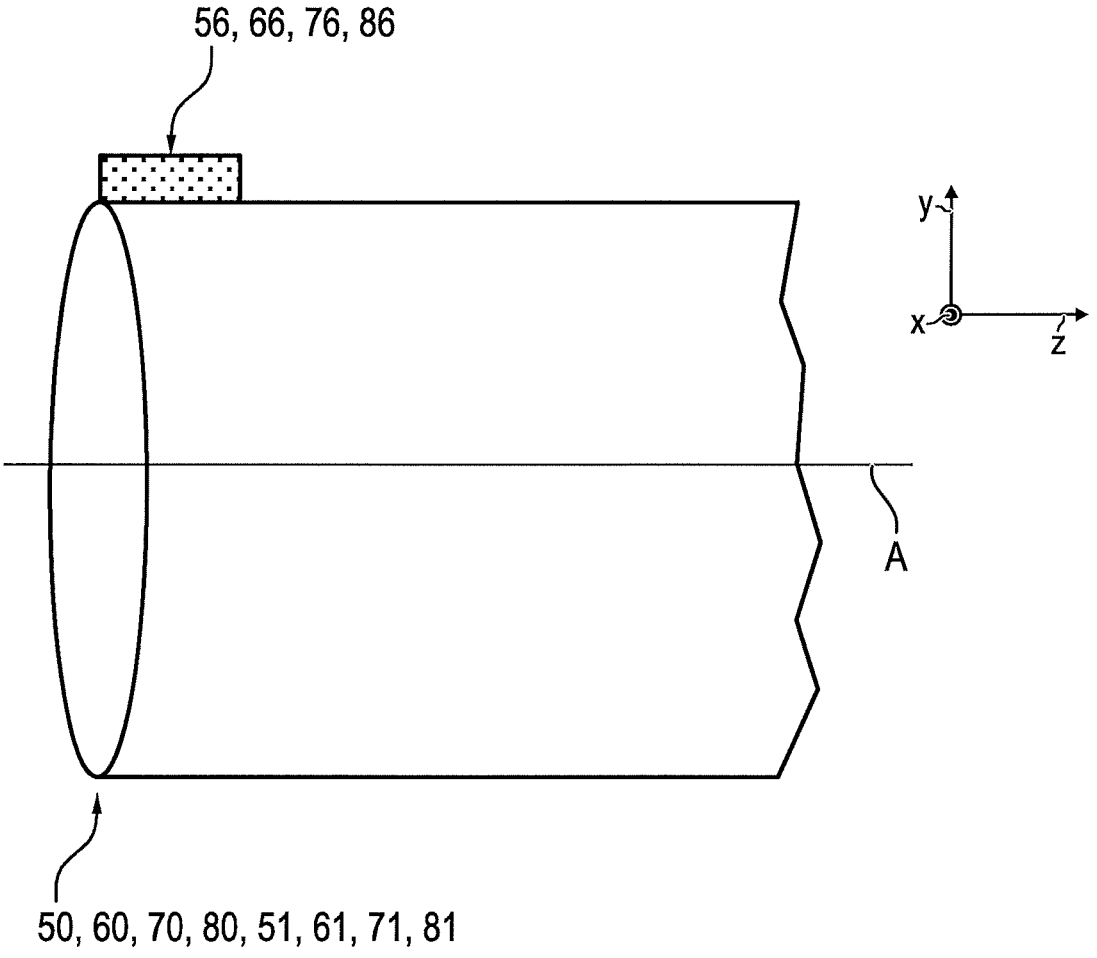

The embodiment shown in FIG. 8 demonstrates a possible location of the engaging element 56, 66, 76, 86 in the front portion of the first and second inlet/outlet opening regions 51, 61, 71, 81 in the direction of the symmetry axis A.

FIGS. 9A to 9F demonstrate by means of schematic and cross-sectional side-views possible shapes of engaging elements 56, 66, 76, 86.

Figure 9A:
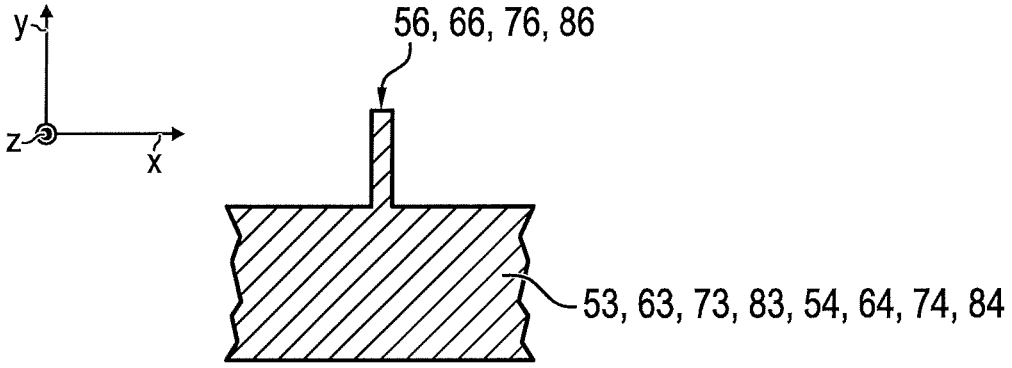

FIGS. 9A, C, E indicate the provision of male protruding engaging elements 56, 66, 76, 86 which have a rectangular, triangular or semi-circular cross-section and which extend from a respective periphery 53, 54, 63, 64, 73, 74, 83, 84.

Figure 9B:
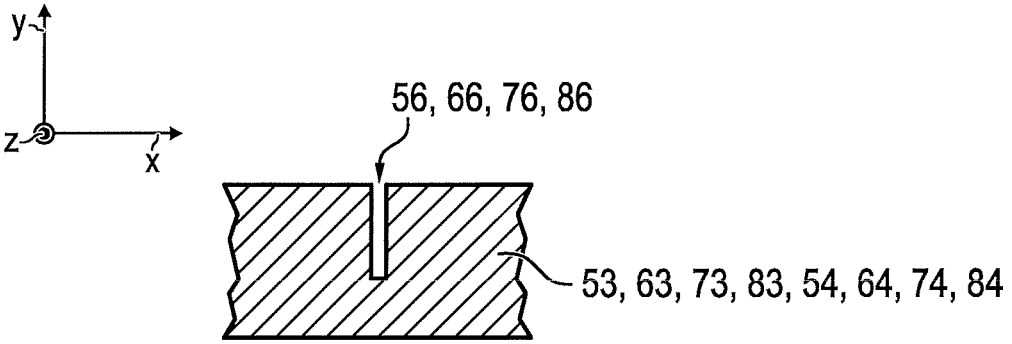
Figure 9C:
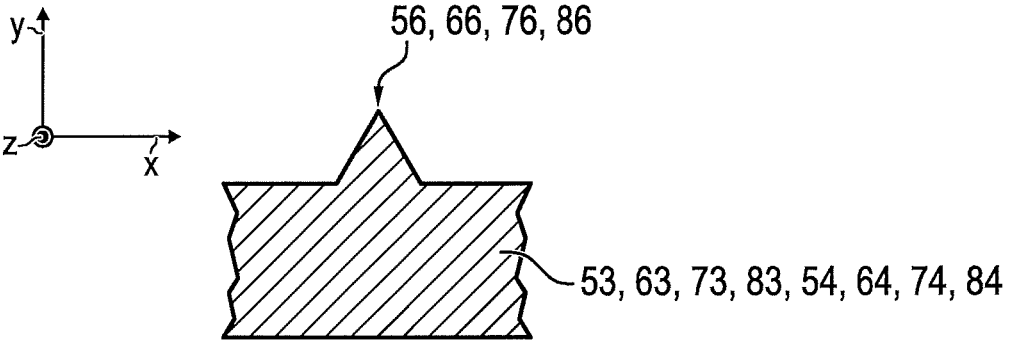
Figure 9D:
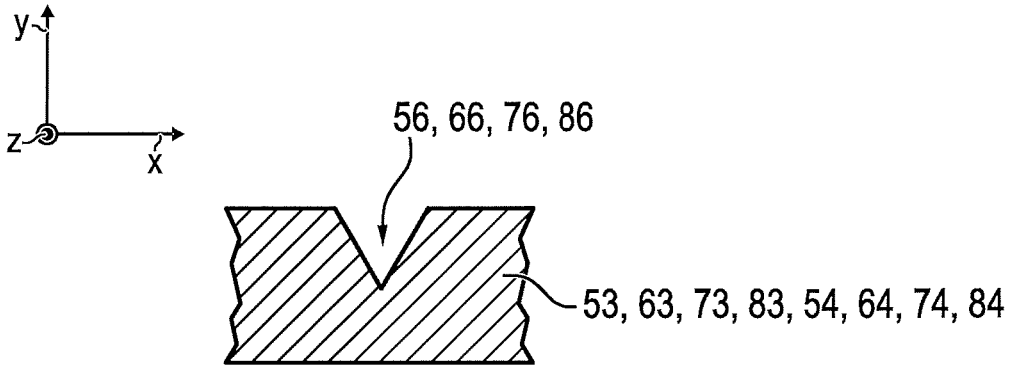
Figure 9E:
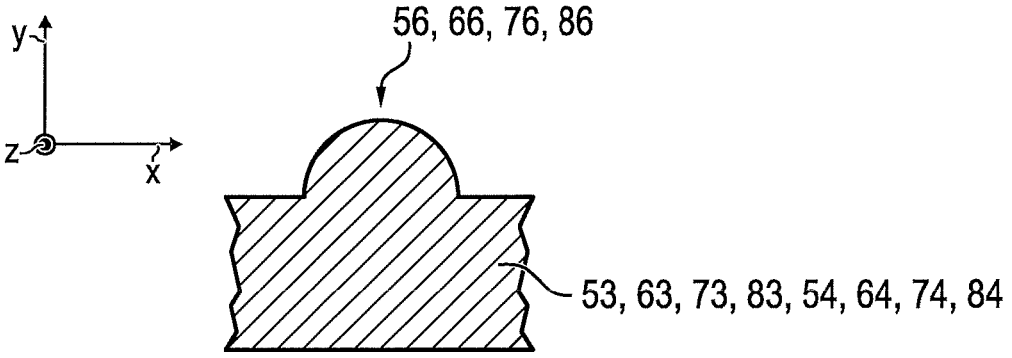
Figure 9F:
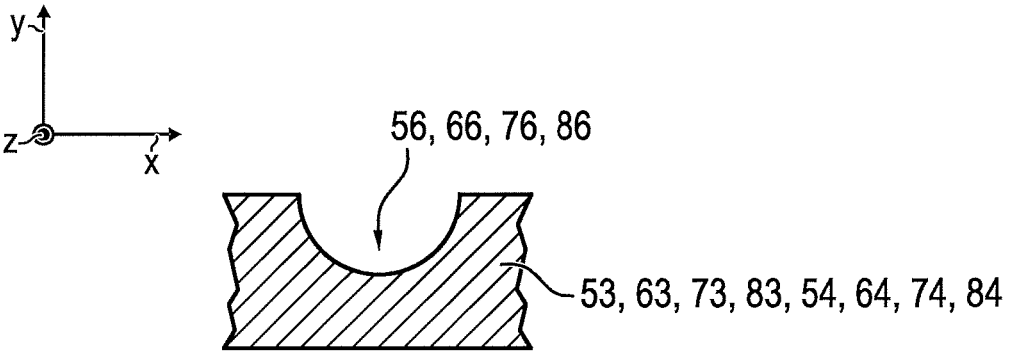

In contrast thereto FIGS. 9B, D, F demonstrate the provision of engaging elements 56, 66,76, 86 in the form of female recesses which recess from the respective periphery 53, 54, 63, 64, 73, 74, 83, 84.

FIGS. 10A to D demonstrate by means of schematic and cross-sectional side-views how first and second inlet and outlet passage 50, 60; 70, 80 can be connected to each other.

Figure 10A:
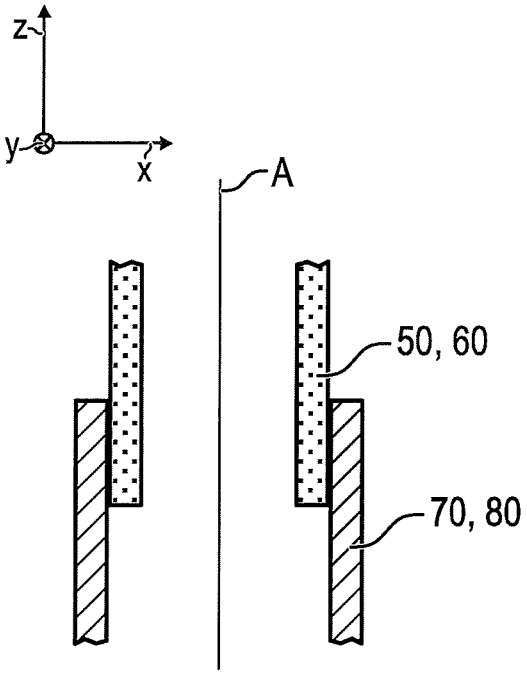

According to FIG. 10A the outer periphery 54, 64 of an inlet passage 50, 60 of a head plate device 45 cooperates and comes into mechanic contact with the inner periphery 73, 83 of an inlet passage 70, 80 of a storage container device 90.

Figure 10B:
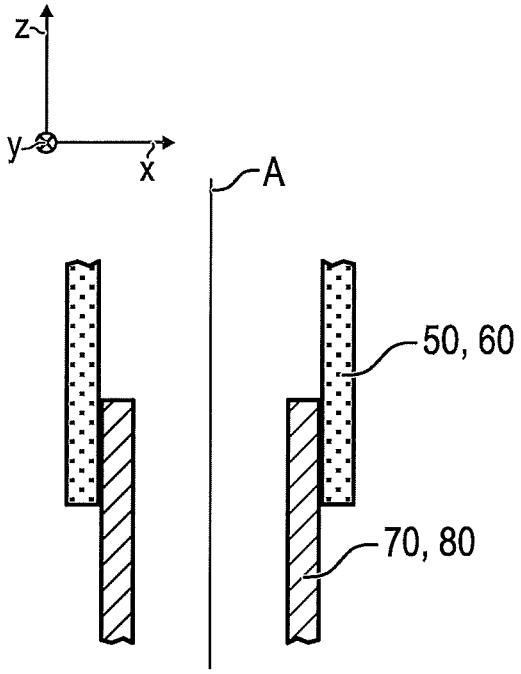

In contrast thereto, FIG. 10B shows that the inner periphery 53, 63 of an inlet passage 50, 60 of a head plate device 10 cooperates with and comes into mechanic contact with a respective outer periphery 74, 84 of an outlet passage 70, 80 of a storage container device 90.

Figure 10C:
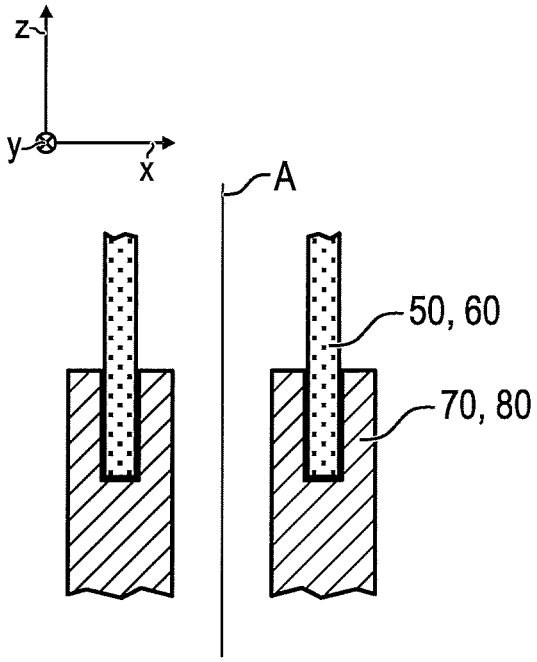
Figure 10D:
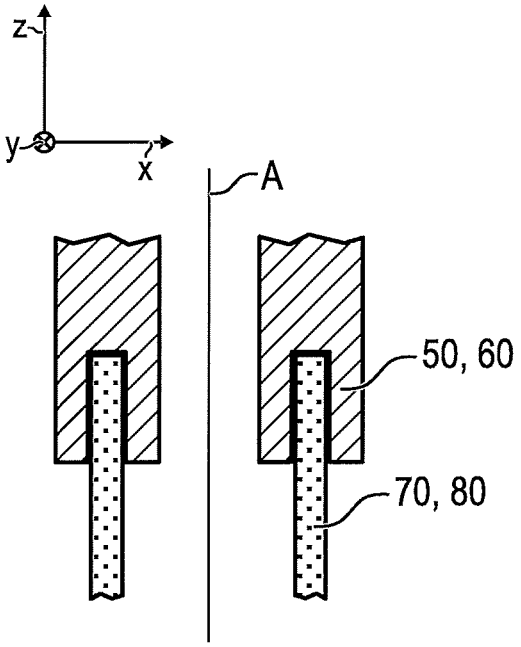

FIGS. 10C and 10D demonstrate that the outlet passage 70, 80 of a storage container device 90 or the inlet passage 50, 60 of a head plate device 10 may be formed with a recess in order to receive the rim formed by the corresponding inlet passage 50, 60 or outlet passage 70, 80, in which case both of the outer periphery 54, 64 or 74, 84 and the inner periphery 53, 63 or 73, 83 either of the inlet passage 50, 60 or the outlet passage 70, 80, respectively, may be provided with respective engaging elements 56, 66, 76, 86.

Figure 11A:
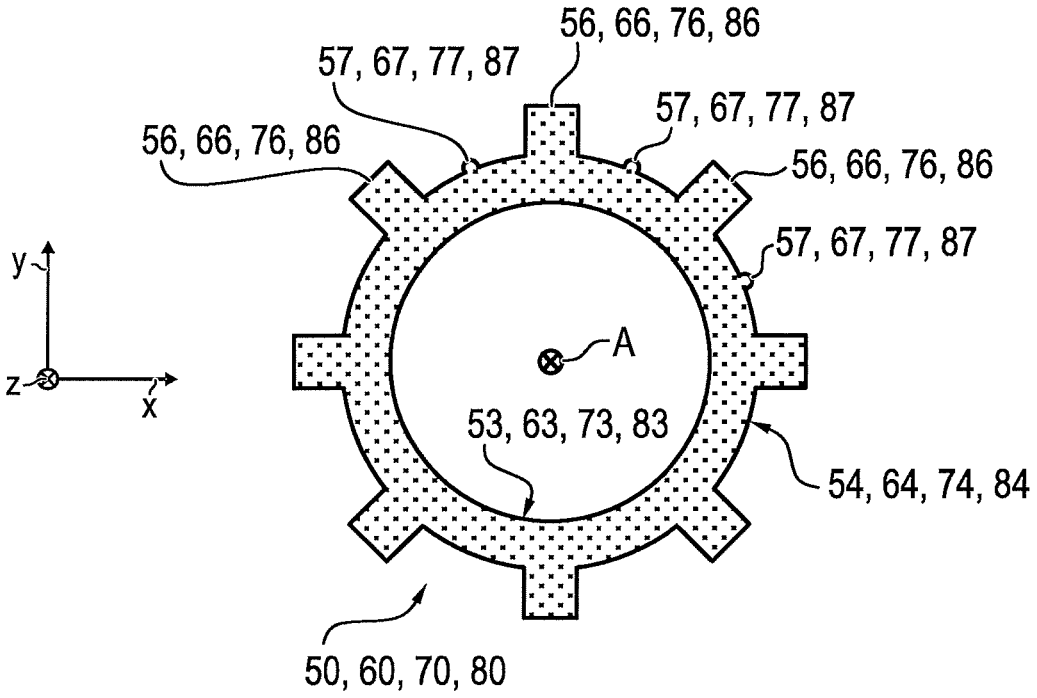
Figure 11B:
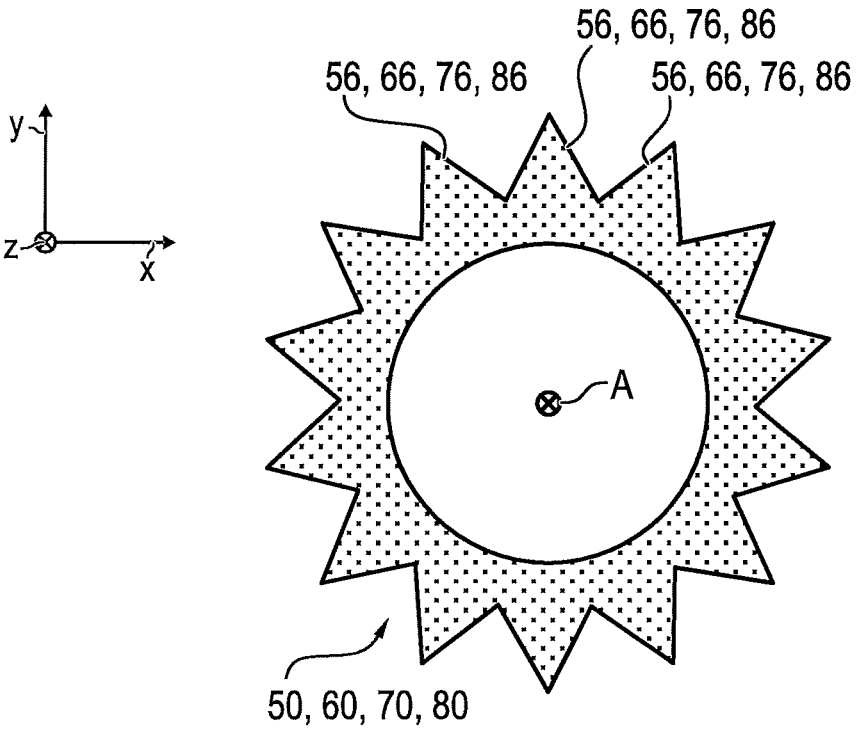

FIGS. 11A and 11B schematically demonstrate that the respective engaging elements 56, 66, 76, 86 may be positioned with a separated gap element 57, 67, 77, 87 between them as shown in FIG. 11A or in direct contact with each other without having the space, separation or gap element 57, 67, 77, 87 between them as shown in FIG. 11B.

FIGS. 12A to 12D demonstrate different possible radial and circumferential extensions for the engaging elements 56, 66, 76, 86 by means of which a tapered structure or configuration is realized and a form-fit, press-fit or force-fit can be obtained.

Figure 12A:
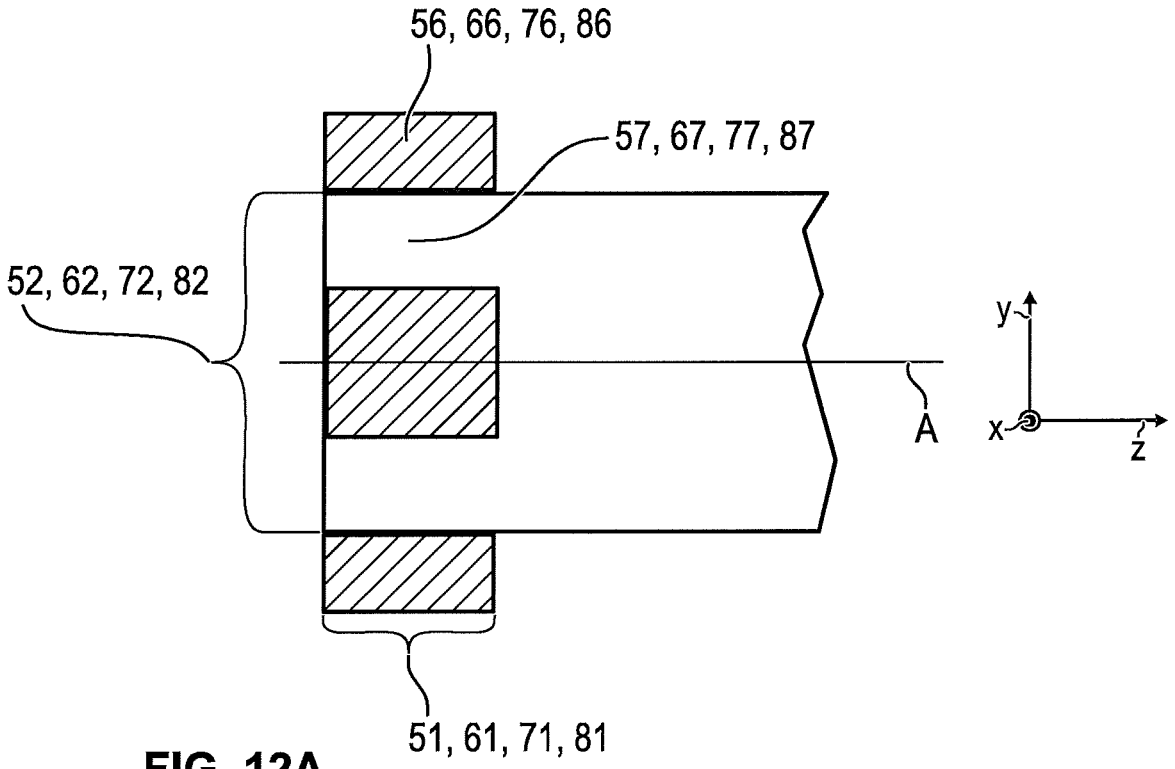

FIG. 12A shows the most simple case where the engaging element 56, 66, 76, 86 has in both the radial direction and the circumferential direction a constant dimension, i.e. a constant width in the circumferential direction and its constant height in the radial direction. Between the respective engaging elements 56, 66, 76, 86 a respective gap, spacing or gap element 57, 67, 77, 87 is provided.

Figure 12B:
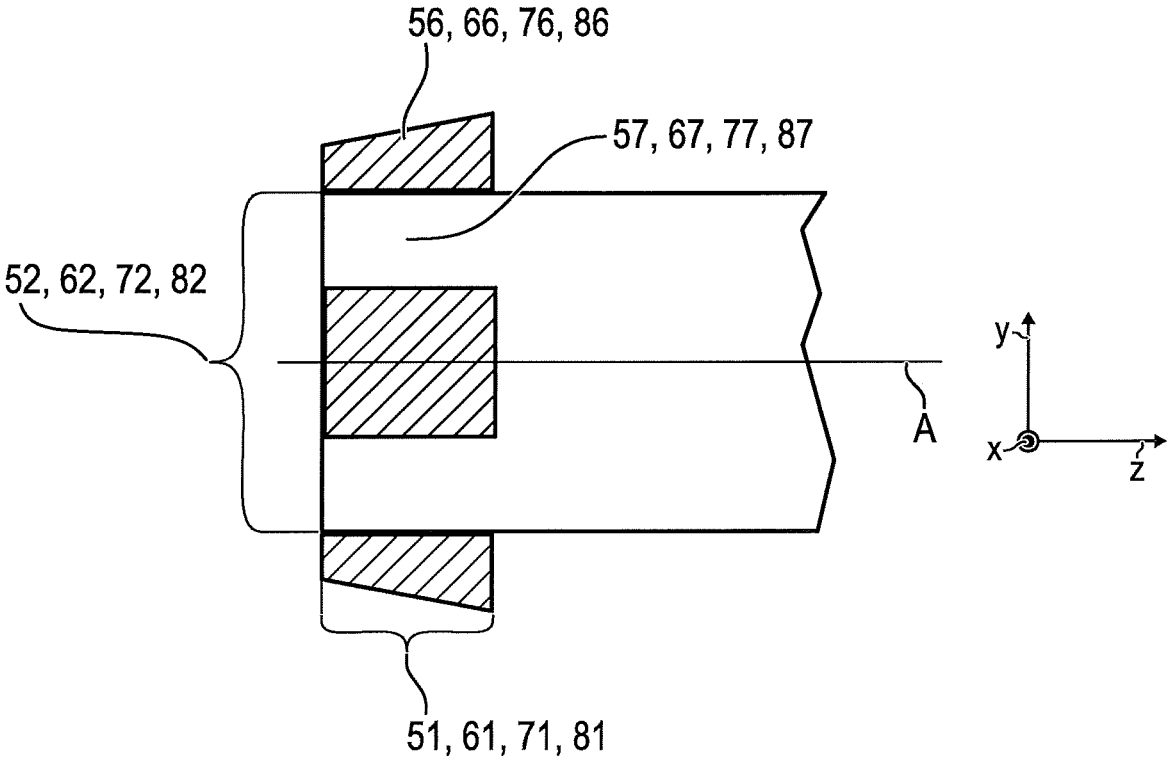

In the embodiment shown in FIG. 12B the width of the engaging elements 56, 66, 76, 86 in the circumferential direction is constant, whereas in the radial direction the height of the engaging element 56, 66, 76, 86 decreases in the direction towards the opening 52, 62, 72, 82.

Figure 12C:
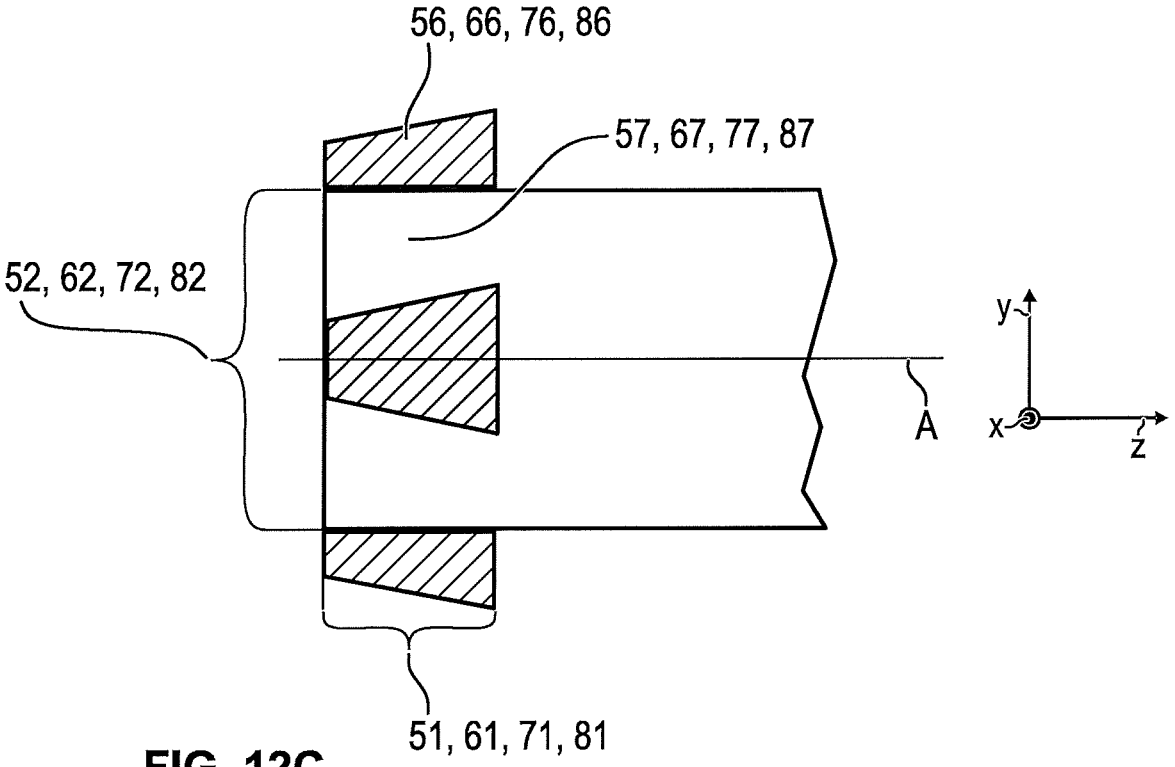
Figure 12D:
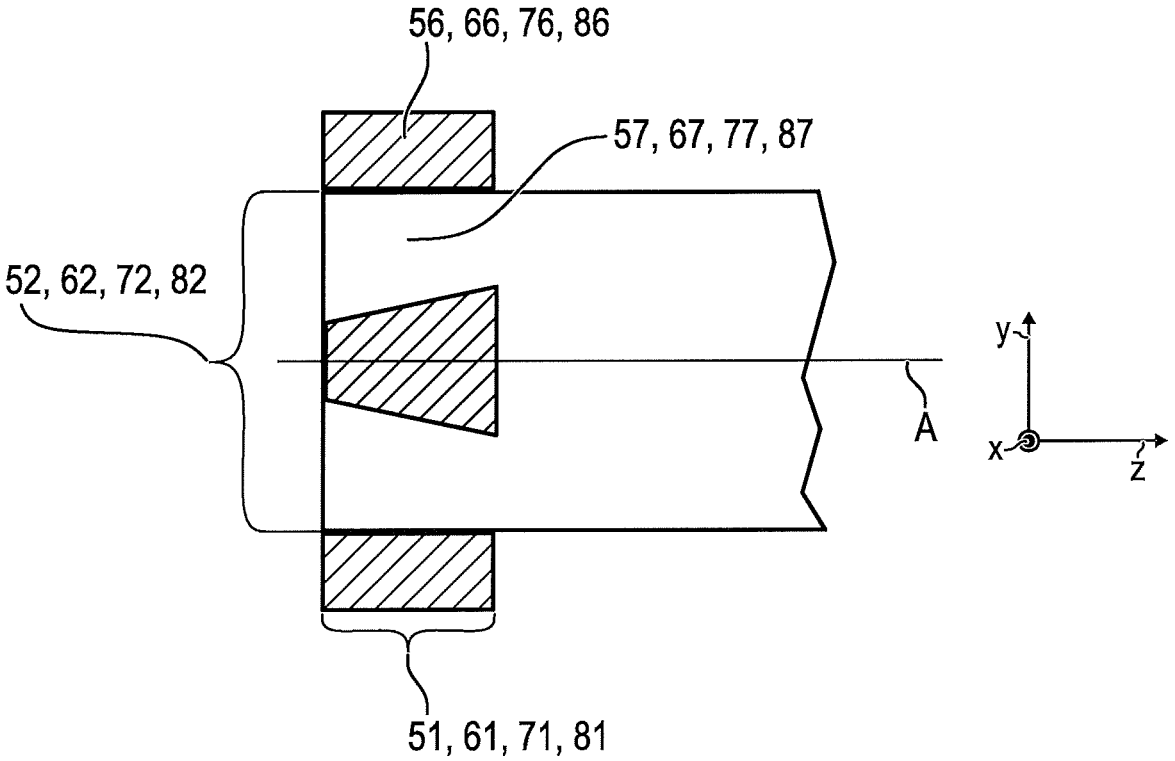

In FIG. 12D the height of the engaging element 56, 66, 76, 86 in the radial direction is constant, whereas the width of the engaging element 56, 66, 76, 86 decreases in the direction towards the opening 52, 62, 72, 82.

FIG. 12C shows a combination of the embodiments of FIGS. 12B and 12D. The height of the engaging element 56,

66, 76, 86 in the radial direction as well as the width of the engaging element 56, 66, 76, 86 in the circumferential direction both decrease from their maximum value at the distal position from the opening 52, 62, 72, 82 to a minimum value in the direction towards the opening 52, 62, 72, 82.

Of course, complementary relations may be achieved when discussing female recesses as of the engaging elements 56, 66, 76, 86 within the respective peripheries 53, 54, 63, 64, 73, 74, 83, 84, wherein the recess depth may increase in the direction towards the opening 52, 62, 72, 82 and/or wherein the width of the recess shall increase in the direction towards the respective opening 52, 62, 72, 82. The latter situations are not depicted in the Figures.

In particular embodiments in line with FIG. 12C or FIG. 12D provide for a self-alignment during the coupling process of the elements to be coupled due to the tapered shape provided by the non-constant width of the engagement elements. This effect is most prominent, if the respective cooperating male and female elements have corresponding tapered shapes.

REFERENCE NUMERALS

1 dispensing apparatus
10 mixer, mixer device, mixing device
11 1st flowable component
12 2nd flowable component
20 mixer housing
25 interior
26 tip, tip portion
30 mixing element, mixer element
40 mixing part, mixing portion
45 head plate, head plate device, intermediate part, intermediate portion
50 1st inlet passage
51 1st inlet opening region
52 1st inlet opening
53 1st inner periphery
54 1st outer periphery
56 engagement element, engaging element
57 gap element, gap, space
60 2nd inlet passage
61 2nd inlet opening region
62 2nd inlet opening
63 2nd inner periphery
64 2nd outer periphery
66 engagement element, engaging element
67 gap element, gap, space
70 1st outlet passage
71 1st outlet opening region
72 1st outlet opening
73 1st inner periphery
74 1st outer periphery
76 engagement element, engaging element
77 gap element, gap, space
80 2nd outlet passage
81 2nd outlet opening region
82 2nd outlet opening
83 2nd inner periphery
84 2nd outer periphery
86 engagement element, engaging element
87 gap element, gap, space
90 storage container device, storage container
91 1st storage chamber
92 2nd storage chamber
96 engagement element, engaging element
97 engagement element, engaging element
98 outlet opening
99 outlet opening
100 cartridge arrangement, cartridge
A symmetry axis
x spatial direction
y spatial direction
z spatial direction

The invention claimed is:

1. A head plate device for a cartridge arrangement for a dispensing apparatus for dispensing at least two flowable components, the head plate device comprising:

at least two separate outlet openings for respectively dispensing at least two flowable components; and at least two separate inlet passages configured to introduce and flow the at least two flowable components separately from one another to a respective one of the outlet openings, wherein:

each of said inlet passages of the head plate device is configured for, sealing cooperation with one respective outlet passage of a storage container device;

at least one of the inlet passages of the head plate device includes an inlet opening region of essentially circularly shaped cross-section with at least one of an inner periphery and an outer periphery;

at least one of the inner periphery and the outer periphery includes at least one engaging element, where the at least one engaging element extends radially from the respective inner periphery or outer periphery;

the at least one engaging element includes a plurality of engaging elements provided on at least one of the inner periphery and the outer periphery of at least one of the inlet or outlet opening region of at least one of the of the inlet and the outlet passages; and individuals of pairs of adjacent engaging elements of the plurality of engaging elements on a respective periphery are positioned either: (1) directly adjacent to and in direct contact with each other, or (2) on the respective periphery with a gap element between them formed by a free portion of the respective periphery.

2. The head plate device according to claim 1, wherein the at least one engaging element is configured to engage with a cooperating and essentially complimentary engaging element of a corresponding outlet passage of a storage container device in a state where the inlet passage of the head plate device, sealingly cooperates with outlet passage of the storage container device, thereby ensuring at least one of:

(i) a snap, lock, latch, or click into place, (ii) a form fit, (iii) a press fit, (iv) a force fit, and (v) a torque proof cooperation between the inlet passage of the head plate device and the outlet passage of the storage container device by preventing at least a rotational movement about a respective symmetry axis (A) underlying the essentially circularly shaped cross-section of the inner periphery and the outer periphery of the inlet passage of the head plate device, thereof.

3. The head plate device according to claim 1, further comprising:

opposed first and second sides, wherein the at least two separate inlet passages are formed on one of the first and second sides;

wherein the at least two separate outlet openings are formed on the other one of the first and second sides; and wherein a number of inlet passages is identical to a number of outlet openings.

4. The head plate device according to claim 1, further comprising:

a plurality of engaging elements wherein a first fraction of the plurality engaging elements is configured for achieving torque proof cooperation between the inlet passage of the head plate device and a respective outlet passage of a storage container device, and wherein a second fraction of the plurality of engaging elements is configured for achieving an engagement between the inlet passage of the head plate device and a respective outlet passage of the storage container device thereby avoiding an axial movement and an inadvertent spatial separation thereof.

5. The head plate device according to claim 4, wherein the at least one engaging element is formed as a male member protruding either from the inner periphery of the respective inlet or outlet opening region of the respective inlet or outlet passage radially inwardly or from the outer periphery of the respective inlet or outlet opening region of the respective inlet or outlet passage radially outwardly.

6. The head plate device according to claim 4, wherein the at least one engaging element is formed as a female member recessing either from the inner periphery of the respective inlet or outlet opening region of the respective inlet or outlet passage radially outwardly or from the outer periphery of the respective inlet or outlet opening region of the respective inlet or outlet passage radially inwardly.

7. The head plate device according to claim 4, wherein the at least one engaging element is formed as or comprises at least one of:

(A) a fin element extending axially and/or circumferentially with respect to the respective inlet or outlet opening region;

(B) a slit extending axially and/or circumferentially with respect to the respective inlet or outlet opening region;

(C) an element with one of a polygonal, rectangular, triangular, semicircular and oval cross section in the axial direction each on the respective periphery and extending axially and/or circumferentially with respect to the respective inlet or outlet opening region;

(D) an elastic and/or solid element extending axially and/or circumferentially with respect to the respective inlet or outlet opening region; and (E) a resilient element extending axially and/or circumferentially and configured for a resilient movement in radial a direction perpendicular to an axial and/or to a circumferential direction with respect to the respective inlet or outlet opening region.

8. The head plate device according to claim 1, wherein each of the plurality of engaging elements is formed with an essentially identical shape.

9. The head plate device according to claim 1, wherein the plurality of engaging elements on the respective periphery is a sequence of alternating male and female structures.

10. The head plate device according to claim 1, wherein the individuals of pairs of adjacent engaging elements of the plurality of engaging elements on the respective periphery are positioned directly adjacent to and in direct contact with each other.

11. The head plate device according to claim 1, wherein the individuals of pairs of adjacent engaging elements of the plurality of engaging elements on the respective periphery are positioned on the respective periphery with the gap element between them formed by the free portion of the respective periphery.

12. The head plate device according to claim 1, further comprising:

at least one engaging element on the respective periphery is configured to achieve a form fit, press fit or force fit, and configured as a male element having a tapered shape with at least one of a reduced height in a radial direction and a reduced width in circumferential direction each towards the respective inlet or outlet opening, or a female element having a tapered shape with at least one of an increased depth in the radial direction and an increased width in circumferential direction each towards the respective inlet or outlet opening.

13. The head plate device according to claim 1, further comprising:

at least one engaging element is configured in order to allow a mechanical coding by way of its shape, its position and/or its orientation on the respective periphery.

14. A storage container device for a cartridge arrangement for a dispensing apparatus and configured for storing a flowable component, the storage container device comprising:

a storage chamber for storing a flowable component; and an outlet passage through which a flowable component is to be discharged; wherein:

the outlet passage of the storage container device is configured for sealing, cooperation with one respective inlet passage of a head plate device, the outlet passage of the storage container device includes an outlet opening region of essentially circularly shaped cross-section with at least one of an inner periphery and an outer periphery;

at least one of the inner periphery and the outer periphery includes at least one engaging element, and the at least one engaging element extends radially from the respective inner periphery or outer periphery; and the at least one engaging element includes a plurality of engaging elements provided on at least one of the inner periphery and the outer periphery of at least one of the inlet or outlet opening region of at least one of the of the inlet and the outlet passages.

15. The storage container device according to claim 14, wherein the at least one engaging element of the outlet passage of the storage container device is configured to engage with a cooperating and essentially complimentary engaging element of a corresponding inlet passage of a head plate device in a state where the outlet passage of the storage container device sealingly, cooperates with the respective inlet passage of the head plate device, thereby ensuring at least one of:

(i) a snap, lock, latch, or click into place, (ii) a form fit, (iii) a press fit, (iv) a force fit, and (v) a torque proof cooperation between the inlet passage of the head plate device and the outlet passage of the storage container device by preventing at least a rotational movement about a respective symmetry axis (A) underlying the essentially circularly shaped cross-section of the inner periphery and the outer periphery of the inlet passage of the head plate device, thereof.

16. A cartridge arrangement for a dispensing apparatus for dispensing at least two flowable components, comprising:

a head plate device having at least two separate outlet openings for respectively dispensing at least two flowable components; and at least two separate inlet passages configured to introduce and flow the at least two flowable components separately from one another to a respective one of the outlet openings, wherein:

each of said inlet passages of the head plate device is configured for, sealing cooperation with one respective outlet passage of a storage container device;

at least one of the inlet passages of the head plate device includes an inlet opening region of essentially circularly shaped cross-section with at least one of an inner periphery and an outer periphery; and at least one of the inner periphery and the outer periphery includes at least one engaging element, where the at least one engaging element extends radially from the respective inner periphery or outer periphery; and at least two storage container devices for receiving or for providing a respective chamber for a respective one of the at least two flowable components, wherein at least one of the storage container devices is configure to include:

a storage chamber for storing a flowable component; and an outlet passage through which a flowable component is to be discharged; wherein:

the outlet passage of the storage container device is configured for sealing, cooperation with one respective inlet passage of a head plate device;

the outlet passage of the storage container device includes an outlet opening region of essentially circularly shaped cross-section with at least one of an inner periphery and an outer periphery;

at least one of the inner periphery and the outer periphery includes at least one engaging element, and the at least one engaging element extends radially from the respective inner periphery or outer periphery;

the at least one engaging element includes a plurality of engaging elements provided on at least one of the inner periphery and the outer periphery of at least one of the inlet or outlet opening region of at least one of the of the inlet and the outlet passages; and individuals of pairs of adjacent engaging elements of the plurality of engaging elements on a respective periphery are positioned either: (1) directly adjacent to and in direct contact with each other, or (2) on the respective periphery with a gap element between them formed by a free portion of the respective periphery.

17. The cartridge arrangement according to claim 16, wherein each of the at least two storage container devices is filled with material of one of the at least two flowable components.

18. A dispensing apparatus for dispensing at least two flowable components, having and comprising:

a cartridge arrangement according to claim 16; and a mixer device, wherein the mixer device is attachable or attached to the cartridge arrangement and configured for receiving from the cartridge arrangement the at least two flowable components, for mixing the at least two flowable components, and for dispensing them in a mixed state.

19. A method for storing, mixing, and/or dispensing at least two flowable components which include at least one of a sealant and an adhesive and/or for at least one of installing, fixing, gluing, sealing, and repairing a window of a wind shield or wind screen of a vehicle, the method comprising:

filling a cartridge with the two flowable components; and dispensing the two flowable components for the cartridge, the cartridge including:

a head plate device having at least two separate outlet openings for respectively dispensing at least two flowable components; and at least two separate inlet passages configured to introduce and flow the at least two flowable components separately from one another to a respective one of the outlet openings, wherein:

each of said inlet passages of the head plate device is configured for, sealing cooperation with one respective outlet passage of a storage container device;

at least one of the inlet passages of the head plate device includes an inlet opening region of essentially circularly shaped cross-section with at least one of an inner periphery and an outer periphery; and at least one of the inner periphery and the outer periphery includes at least one engaging element, where the at least one engaging element extends radially from the respective inner periphery or outer periphery; and the cartridge being in combination with:

at least two storage container devices for receiving or for providing a respective chamber for a respective one of the at least two flowable components, wherein at least one of the storage container devices is configure to include:

a storage chamber for storing a flowable component; and an outlet passage through which a flowable component is to be discharged; wherein:

the outlet passage of the storage container device is configured for sealing, cooperation with one respective inlet passage of a head plate device;

the outlet passage of the storage container device includes an outlet opening region of essentially circularly shaped cross-section with at least one of an inner periphery and an outer periphery;

at least one of the inner periphery and the outer periphery includes at least one engaging element, and the at least one engaging element extends radially from the respective inner periphery or outer periphery;

the at least one engaging element includes a plurality of engaging elements provided on at least one of the inner periphery and the outer periphery of at least one of the inlet or outlet opening region of at least one of the of the inlet and the outlet passages; and individuals of pairs of adjacent engaging elements of the plurality of engaging elements on a respective periphery are positioned either: (1) directly adjacent to and in direct contact with each other, or (2) on the respective periphery with a gap element between them formed by a free portion of the respective periphery.

* * * * *